US006937837B2

(12) United States Patent
Takeuchi et al.

(10) Patent No.: US 6,937,837 B2
(45) Date of Patent: Aug. 30, 2005

(54) IMAGE HEATING APPARATUS HAVING A LIMITING MEMBER

(75) Inventors: Akihiko Takeuchi, Susono (JP); Masahiro Suzuki, Numazu (JP); Tatsuro Hayakawa, Numazu (JP); Takayuki Miyamoto, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 279 days.

(21) Appl. No.: 10/057,969

(22) Filed: Jan. 29, 2002

(65) Prior Publication Data

US 2002/0110394 A1 Aug. 15, 2002

(30) Foreign Application Priority Data

Jan. 31, 2001 (JP) ..... 2001-024327

(51) Int. Cl.[7] ..... G03G 15/20
(52) U.S. Cl. ..... 399/328; 219/216; 219/619
(58) Field of Search ..... 399/328, 329, 399/320, 330; 219/216, 619, 388

(56) References Cited

U.S. PATENT DOCUMENTS

| | | | | |
|---|---|---|---|---|
| 5,083,168 A | | 1/1992 | Kusaka et al. | 399/329 |
| 5,149,941 A | | 9/1992 | Hirabayashi et al. | 219/216 |
| 5,162,634 A | | 11/1992 | Kusaka et al. | 219/216 |
| 5,196,895 A | * | 3/1993 | Setoriyama et al. | 399/328 |
| 5,210,579 A | | 5/1993 | Setoriyama et al. | 399/338 |
| 5,253,024 A | | 10/1993 | Okuda et al. | 399/324 |
| 5,293,202 A | | 3/1994 | Adachi et al. | 399/323 |
| 5,331,385 A | | 7/1994 | Ohtsuka et al. | 399/331 |
| 5,343,280 A | | 8/1994 | Hirabayashi et al. | 399/67 |
| 5,525,775 A | | 6/1996 | Setoriyama et al. | 219/216 |
| 5,543,904 A | | 8/1996 | Kato et al. | 399/335 |
| 5,722,026 A | | 2/1998 | Goto et al. | 399/333 |
| 6,014,539 A | * | 1/2000 | Sano et al. | 399/329 |
| 6,049,691 A | * | 4/2000 | Abe et al. | 399/328 X |
| 6,072,964 A | | 6/2000 | Abe et al. | 399/69 |
| 6,131,010 A | | 10/2000 | Kume et al. | 399/333 |
| 6,347,211 B2 | | 2/2002 | Nanataki et al. | 399/328 |
| 6,359,269 B1 | * | 3/2002 | Hayasaki et al. | 219/619 X |

FOREIGN PATENT DOCUMENTS

| | | |
|---|---|---|
| JP | 51-109737 | 9/1976 |
| JP | 63-313182 | 12/1988 |
| JP | 02-157878 | 6/1990 |
| JP | 4-44075 | 2/1992 |
| JP | 04-204980 | 7/1992 |
| JP | 7-295411 | 11/1995 |
| JP | 2000-347529 | 12/2000 |

* cited by examiner

*Primary Examiner*—Sophia S. Chen
(74) *Attorney, Agent, or Firm*—Fitzpatrick, Cella, Harper & Scinto

(57) ABSTRACT

An image heating apparatus includes a rotatable member contactable to a recording material carrying an image; and a limiting member for limiting movement of the rotatable member in a direction of a generating line of the rotatable member, wherein the limiting member is provided with a surface opposed to an outer peripheral surface at an end portion of the rotatable member.

17 Claims, 14 Drawing Sheets

IMAGE HEATING APPARATUS HAVING A LIMITING MEMBER

FIELD OF THE INVENTION AND RELATED ART

The present invention relates to an image heating apparatus such as a thermal fixing device mounted in an image forming apparatus such as a copying machine, a printer, or the like. In particular, it relates to an image heating apparatus comprising: a rotational member which makes contact with a recording medium, on which an image is borne; and a regulating member for regulating the movement of the rotational member in the direction parallel to the generatrix of the rotational member.

First, the prior arts regarding an image heating apparatus will be described with reference to a fixing apparatus for an image forming apparatus such as an electrophotographic copying machine, a printer, or the like.

In an image forming apparatus, a toner image is indirectly (transfer) or directly formed on a recording medium (paper) with the use of an optional image forming process, for example, an electrophotographic process. After the formation of a toner image on a recording medium, the toner image, or an unfixed toner image, must be permanently fixed to the surface of the recording medium. As for a means for fixing an unfixed toner image to a recording medium, there have been various fixing apparatuses (fixing devices), which thermally fix an unfixed toner image to a recording medium. Among the various fixing apparatuses, heat roller type heating apparatuses have been widely used.

In recent years, in consideration of "quick start" or "energy conservation", film heating type heating apparatuses have been put to practical use. Further, there has been proposed an electromagnetic induction type heating apparatus, in which heat is directly generated in the metallic film itself through electromagnetic induction.

a) Film Heating Type Fixing Apparatus

A film heating type fixing apparatus has been proposed in Japanese Laid-Open Patent Applications 63-313182, 2-157878, 4-44075, 4-204980, and the like.

A film heating type fixing apparatus comprises: a ceramic heater as a heating member; a pressure roller as a pressure applying member, which is pressed upon the ceramic heater, forming a compression nip (which hereinafter will be referred to as fixing nip); and a heat resistant film (which hereinafter will be referred to as fixing film), which is sandwiched by the ceramic heater and pressure roller, in the fixing nip. In operation, a recording medium, on which an unfixed toner image is borne, is introduced between the fixing film and pressure roller, in the fixing nip, and is conveyed with the fixing film, through the fixing nip. As the recording medium is conveyed, being pressed upon the fixing film by the pressure roller, the heat from the ceramic heater is given to the recording medium and the unfixed toner image thereon. As a result, the unfixed toner image on the recording medium is fixed to the surface of the recording medium by the heat from the ceramic heater and the pressure applied by the pressure roller.

With the use of a combination of a ceramic heater of a low thermal capacity and a film of a low thermal capacity, a film heating type fixing apparatus can be constructed as a on-demand type fixing apparatus, that is, a fixing apparatus in which power needs to be supplied to a ceramic heater, as a heat source, to realize a predetermined fixing temperature, only when an image is actually formed. Therefore, a film type fixing apparatus can offer to an image forming apparatus the following benefits: the time it takes for an image forming apparatus to become ready for image formation after it is turned on is shorter (quick start), and the amount of the power consumption of the image forming apparatus during its standby period is drastically smaller (energy conservation), compared to an image forming apparatus which does not employs a film type fixing apparatus.

b) Electromagnetic Induction Heating Type Fixing Apparatus

Japanese Laid-Open U.M. Application 51-109739 discloses an induction heating type fixing apparatus, in which the fixing film is heated with the heat (Joule heat) generated in the metallic layer (heat generating layer) of the fixing film by inducing eddy current with the use of a magnetic flux. In other words, in this fixing apparatus, the fixing film is directly heated by inducing electric current in the fixing film. Therefore, this fixing apparatus accomplishes a higher heating efficiency, or a fixing process with a higher efficiency, compared to a heat roller type apparatus employing a halogen lamp as a heat source.

FIG. 20 shows the general structure of an example of an electromagnetic induction heating type fixing apparatus.

In the drawing, a referential code 10 designates a fixing film (which hereinafter will be referred to as a sleeve) comprising an electromagnetic induction type heat generating layer (electrically conductive layer, magnetic layer, electrically resistive layer). The fixing film 10 is cylindrical and flexible, and can be rotationally driven.

A referential code 16*c* designates a film guiding member (which hereinafter will be referred to as sleeve guiding member) in the form of a trough, which is approximately semicircular in cross section. The sleeve 10 is loosely fitted around the sleeve guiding member 16*c*.

A referential code 15 designates a magnetic field generating means disposed within the sleeve guiding member 16*c*. The magnetic field generating means comprises an exciting coil 18, and a magnetic core 17 having an E-shaped cross section.

Designated by a referential code 30 is an elastic pressure roller, which is kept pressed upon the bottom surface of the sleeve guiding member 16*c*, with the interposition of the sleeve 10, with the application of a predetermined pressure, forming a fixing nip N having a predetermined width.

The magnetic core 17 of the magnetic field generating means 15 is disposed so that its position corresponds to the position of the fixing nip N.

The pressure roller 30 is rotationally driven by a driving means M, in the counterclockwise direction indicated by an arrow mark in the drawing. As the pressure roller 30 is rotationally driven, friction occurs between the peripheral surface of the pressure roller and the outwardly facing surface of the sleeve 10, in the fixing nip N. As a result, the sleeve 10 is rotated by the pressure roller 30, around the sleeve guiding member 16*c*, in the clockwise direction indicated by an arrow mark in the drawing, at a peripheral velocity substantially equal to the peripheral velocity of the pressure roller 30, with the inwardly facing surface of the sleeve 10 sliding on the bottom surface of the sleeve guiding member 16*c*, in the fixing nip N (pressure roller driving method).

The sleeve guiding member 16*c* plays the role of maintaining the fixing pressure in the fixing nip N, the role of supporting the magnetic field generating means 15 comprising the combination of the exciting coil and magnetic core 17, the role of supporting the sleeve 10, and the role of keeping the sleeve 10 stable while the sleeve 10 is rotationally driven. The sleeve guiding member 16*c* is formed of such a material that does not prevent the passage of a magnetic flux through the sleeve guiding member 16*c* and that can withstand a large amount of load.

The exciting coil 18 generates an alternating magnetic flux as alternating current is supplied to the exciting coil 18 from an unshown exciting circuit. The alternating magnetic flux generated by the exciting coil 18 is concentrated to the fixing nip N, by the magnetic coil 17 with the E-shaped cross section disposed so that its position corresponds to that of the fixing nip N. The magnetic flux concentrated to the fixing nip N generates eddy current in the electromagnetic induction type heat generating layer of the sleeve 10. This eddy current and the specific resistance of the electromagnetic induction type heat generating layer generates heat (Joule heat) in the electromagnetic induction type heat generating layer. With the presence of the magnetic core 17 with the E-shaped cross section which concentrates the alternating magnetic field to the fixing nip N, the heat generation is concentrated to the portion of the sleeve 10 within the fixing nip N. Therefore, the fixing nip N is highly efficiently heated.

The temperature of the fixing nip N is kept at a predetermined level by a temperature control system, inclusive of an unshown temperature detecting means, which controls the current supply to the exciting coil 18.

Thus, as the pressure roller 30 is rotationally driven, the sleeve 10 is rotated around the sleeve guiding member 16*c*, while current is supplied to the exciting coil 18 from the exciting circuit. As a result, heat is generated in the sleeve 10 through electromagnetic induction, increasing the temperature of the fixing nip N to a predetermined level, at which it is kept. In this state, a recording medium P, on which an unfixed toner image t has been formed, is conveyed to the fixing nip N, or the interface between the sleeve 10 and pressure roller 30, with the image bearing surface of the recording medium P facing upward, in other words, facing the surface of th fixing sleeve. In the fixing nip N, the recording Medium P is conveyed with the sleeve 10, being sandwiched between the sleeve 10 and pressure roller 30, the image bearing surface of the recording medium P remaining flatly in contact with the outwardly facing surface of the sleeve 10. While the recording medium P is conveyed through the fixing nip N, the recording medium P and the unfixed toner image t thereon are heated by the heat generated in the sleeve 10 by electromagnetic induction. As a result, the unfixed toner image t is permanently fixed to the recording medium P. After being passed through the fixing nip N, the recording medium P is separated from the peripheral surface of the rotating sleeve 10, and then, is conveyed further to be discharged from the image forming apparatus.

An electromagnetic induction heating type fixing apparatus employs thin metallic film (Ni film, SUS film, or the like), or an approximately 50 $\mu$m thick metallic film, as the material for the sleeve 10. Therefore, the sleeve 10 is relatively rigid. Thus, an electromagnetic induction heating type fixing apparatus has suffered from the following problem. That is, as the sleeve 10 is rotationally driven around the sleeve guiding member 16*c*, the lengthwise end portions of the sleeve 10 come into contact with the side plates or the like of the fixing apparatus, sometimes buckling due to the contact. Eventually, the lengthwise end portions of the sleeve 10 crack, sometimes resulting in the destruction of the sleeve 10, because of its relatively high level of rigidity.

This phenomenon also reduces the durability of a film heating type fixing apparatus such as the above described one (a), when the aforementioned metallic sleeve is used as the fixing film, in place of the customary fixing film formed of heat resistant resin such as PI (polyimide), in order to improve the durability of the fixing film of the film heating type fixing apparatus.

As for the countermeasure for the above-described problem, in other words, a means for preventing the edges of the sleeve 10 from rubbing against the members of the fixing apparatus adjacent to the edges of the sleeve 10, it is possible to provide the fixing apparatus with a flange 201, the flange 201 having a diameter r1 slightly smaller than the inner diameter r2 of sleeve 10, as an edge protection member, which is disposed at the edges of the sleeve 10 and rotates with the sleeve 10, as shown in FIG. 21.

However, the provision of the flange 201 has created the following new problem. That is, as pressure is applied to the sleeve 10, by the pressure roller 30, in the direction indicated by an arrow mark A in FIG. 22, the portion of the sleeve 10 in contact with the pressure roller 30, is displaced inward of the sleeve 10, causing the portion of the sleeve 10 outside the range of the pressure roller 30 (portion of sleeve 10 which is not in contact with pressure roller 30) to bend, because the presence of the flange 201 prevents the end portions of the sleeve 10 from changing in internal diameter. The stress resulting from this bending of the sleeve 10 is largest at a point B, that is, the border between the portion of the sleeve 10, which is in contact with the pressure roller 30, and the portion of the sleeve 10, which is not in contact with the pressure roller 30. Therefore, as the cumulative amount of the sleeve usage increases, the sleeve 10 breaks at the point B due to fatigue.

SUMMARY OF THE INVENTION

The present invention was made in consideration of the above described problems. Its primary object is to provide an image heating apparatus, the rotational member of which is more durable than that in accordance with the prior arts.

Another object of the present invention is to provide an image heating apparatus comprising:

a rotational member which makes contact with a recording medium which is bearing an image; and a regulating member for regulating the movement of said rotational member in the direction parallel to the generatrix of said rotational member, wherein said regulating member is provided with a surface which faces the edge of said rotational member.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

<Embodiment 1>

(1) Image Forming Apparatus

Figure 1:
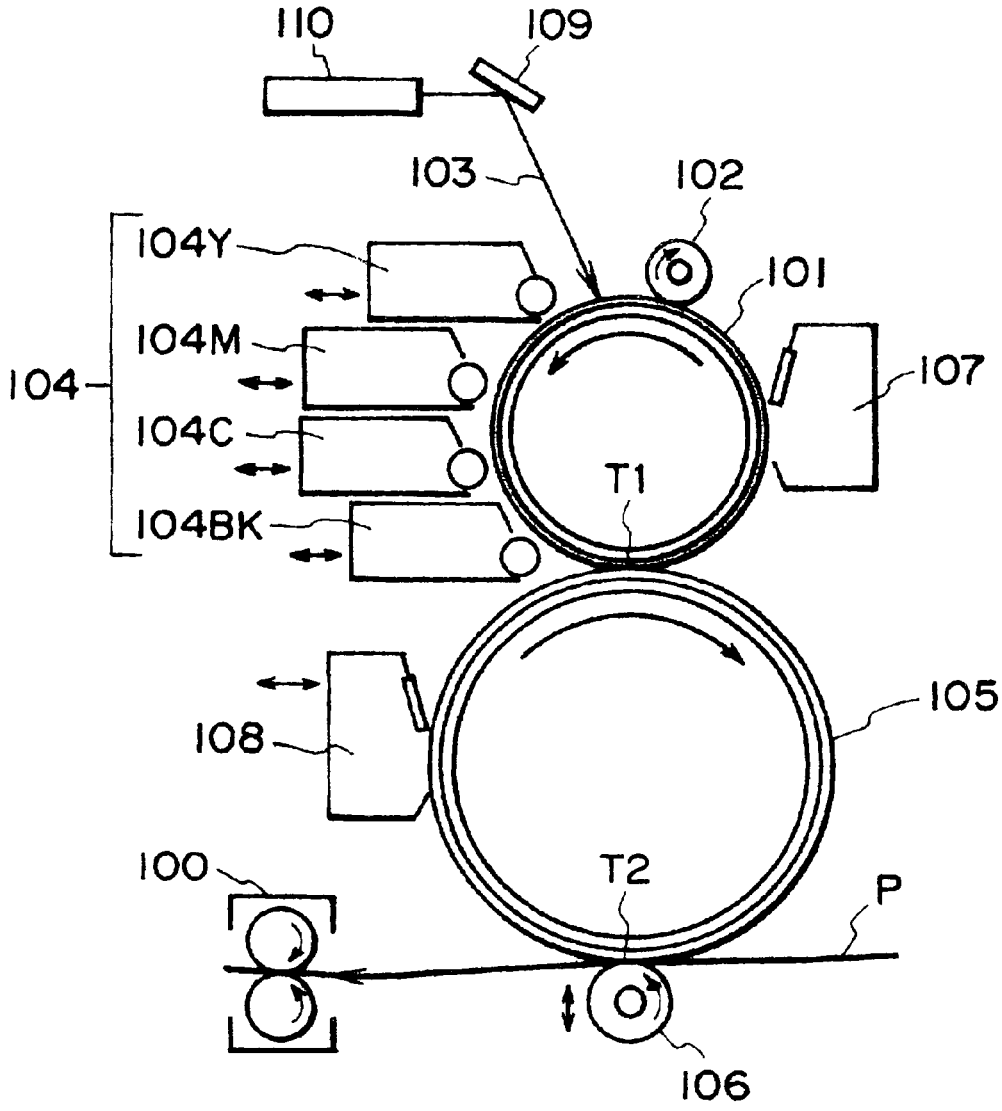
FIG. 1 is a schematic sectional view of the image forming apparatus in the first embodiment of the present invention, and shows the general structure thereof.

FIG. 1 is a schematic sectional view of an example of an image forming apparatus enabled to employ a heating apparatus in accordance with the present invention, as a fixing apparatus 100. In this embodiment, the image forming apparatus is a color laser printer.

A referential code 101 designates a photoconductive drum (image bearing member), the photoconductive portion of which is formed of organic photoconductor or amorphous silicon. The photoconductive drum 101 is rotationally driven in the clockwise direction indicated by an arrow mark at a predetermined process speed (peripheral velocity).

While the photoconductive drum 101 is rotationally driven, its peripheral surface is uniformly charged to predetermined polarity and potential level, by a charging apparatus 102 such as a charge roller.

The uniformly charged surface of the photoconductive drum 101 is scanned by a beam of laser light 103 outputted, while being modulated with the image formation data of an intended image, from a laser optic box 110 (laser scanner); the laser optic box 110 outputs the laser beam 103 from an unshown image signal generating apparatus such as an image reading apparatus, while modulating (turning on or off it with sequential electrical digital picture element signals in accordance with the image formation data of an intended image. As a result, an electrostatic latent image in accordance with the image formation data of the intended image is formed on the scanned peripheral surface of the photoconductive drum 101. Designated by a referential code 109 is a mirror for deflecting the laser beam 103 outputted from the laser optic box 110, toward a specific point on the peripheral surface of the photoconductive drum 101, which is to be exposed.

When forming a full-color image, a latent image correspondent to a first color component, for example, yellow component, of an intended full-color image is formed on the uniformly charged peripheral surface of the photoconductive drum 101 by scanning the peripheral surface of the photoconductive drum 101 with the laser beam modulated with the image formation data correspondent to the first color (yellow) component of the intended full-color image. Then, the latent image is developed into a yellow toner image by the activation of the yellow color developing device 104Y, or one of the four color developing apparatuses 104. Then, the yellow toner image is transferred onto the surface of the intermediary transfer drum 105, in the primary transfer portion T1, that is, the interface (inclusive of the adjacencies thereto between the photoconductive drum 101 and intermediary transfer drum 105. After the transfer of the yellow toner image onto the surface of the intermediary transfer drum 105, the peripheral surface of the photoconductive drum 101 is cleaned with a cleaner 107; the residues, for example, toner particles, remaining on the peripheral surface of the photoconductive drum 101, are removed by the cleaner 107.

The above described process cycle comprising charging, scanning/exposing, developing, primary transferring, and cleaning processes is carried out in sequence for the second (for example, magenta color, activation of magenta color developing device 104M), third (for example, cyan color; activation of cyan color developing device 104C), and fourth (for example, black color; activation of black color developing device 104BK) color components of the intended full-color image. As a result, four color toner images, that is, the yellow toner image, magenta toner image, cyan toner image, and black toner image, are placed in layers on the surface of the intermediary transfer drum 105, creating a color toner image virtually identical to the intended full-color image.

The intermediary transfer drum 105 comprises a metallic drum, an elastic layer coated on the peripheral surface of the metallic drum, and a surface layer coated over the elastic layer. The electrical resistances of the elastic layer and surface layer are in the medium and high ranges, respectively. The intermediary transfer drum 105 is disposed so that its peripheral surface remains in contact with, or close to, the peripheral surface of the photoconductive drum 101. It is rotationally driven in the clockwise direction indicated by an arrow mark at approximately the same peripheral velocity as that of the photoconductive drum 101. The toner image on the peripheral surface of the photoconductive drum 101 is transferred onto the peripheral surface of the intermediary transfer drum 105 by creating a difference in potential level between the peripheral surfaces of the intermediary transfer drum 105 and photoconductive drum 101. As for the method for creating this potential level difference, bias voltage is applied to the metallic drum of the intermediary transfer drum 105.

The color toner images on the intermediary transfer drum 105 are transferred onto a recording medium P (which hereinafter will be referred to as transfer medium or paper), in a secondary transfer portion T2, that is, the nip, or interface, between the peripheral surface of the intermediary transfer drum 105 and photoconductive drum 101. More concretely, the recording medium P is conveyed into the secondary transfer portion T2 from an unshown sheet feeding portion. As the recording medium P is conveyed through the secondary transfer portion T2, such electrical charge that is opposite in polarity to the toner is supplied to the transfer medium P from the back surface side of the transfer medium P. As a result, the four color toner images, or the four components of a synthetic full-color image, are transferred all at once onto the transfer medium P from the peripheral surface of the intermediary transfer drum 105.

After passing through the secondary transfer portion T2, the transfer medium P is separated from the peripheral surface of the intermediary transfer drum 105, and is introduced into the fixing apparatus 100 (image heating apparatus), in which the unfixed color toner images are thermally fixed to the transfer medium P. Then, the transfer medium P is discharged into an unshown external delivery tray.

After the transfer of the color toner images onto the transfer medium P, the intermediary transfer drum 105 is cleaned by a cleaner 108; the residues, such as toner particles or paper dust, remaining on the peripheral surface of the intermediary transfer drum 105 are removed by the cleaner 108.

Normally, the cleaner 108 is not kept in contact with the intermediary transfer drum 105; it is kept in contact with the intermediary transfer drum 105 only while the color toner images are transferred (secondary transfer) from the intermediary transfer drum 105 onto the transfer medium P.

Normally, the transfer roller 106 is not kept in contact with the intermediary transfer drum 105; it is kept pressed against the intermediary transfer drum 105, with the interposition of the transfer medium P, only while the color toner images are transferred (secondary transfer) from the intermediary transfer drum 105 onto the transfer medium P.

The image forming apparatus in this embodiment is capable of carrying out a monochromatic printing mode; for example, it can prints a black-and-white image. It also is capable of carrying out a double-sided printing mode.

In a double-side printing mode, after the formation of an image on one of the two surfaces of the transfer medium P, the transfer medium P is put through the fixing apparatus 100. Then, it is turned over through an unshown recirculating/conveying mechanism, and is sent again into the secondary transfer portion T2, in which a single or plurality of toner images are transferred onto the other surface of the transfer medium P. Then, the transfer medium P is introduced for the second time into the fixing apparatus 100, in which the unfixed toner image or images on the second surface are fixed to the second surface. Then, the transfer medium P is discharged as a double-sided print.

(2) Fixing Apparatus 100

A) General Structure of Fixing Apparatus

Figure 2:
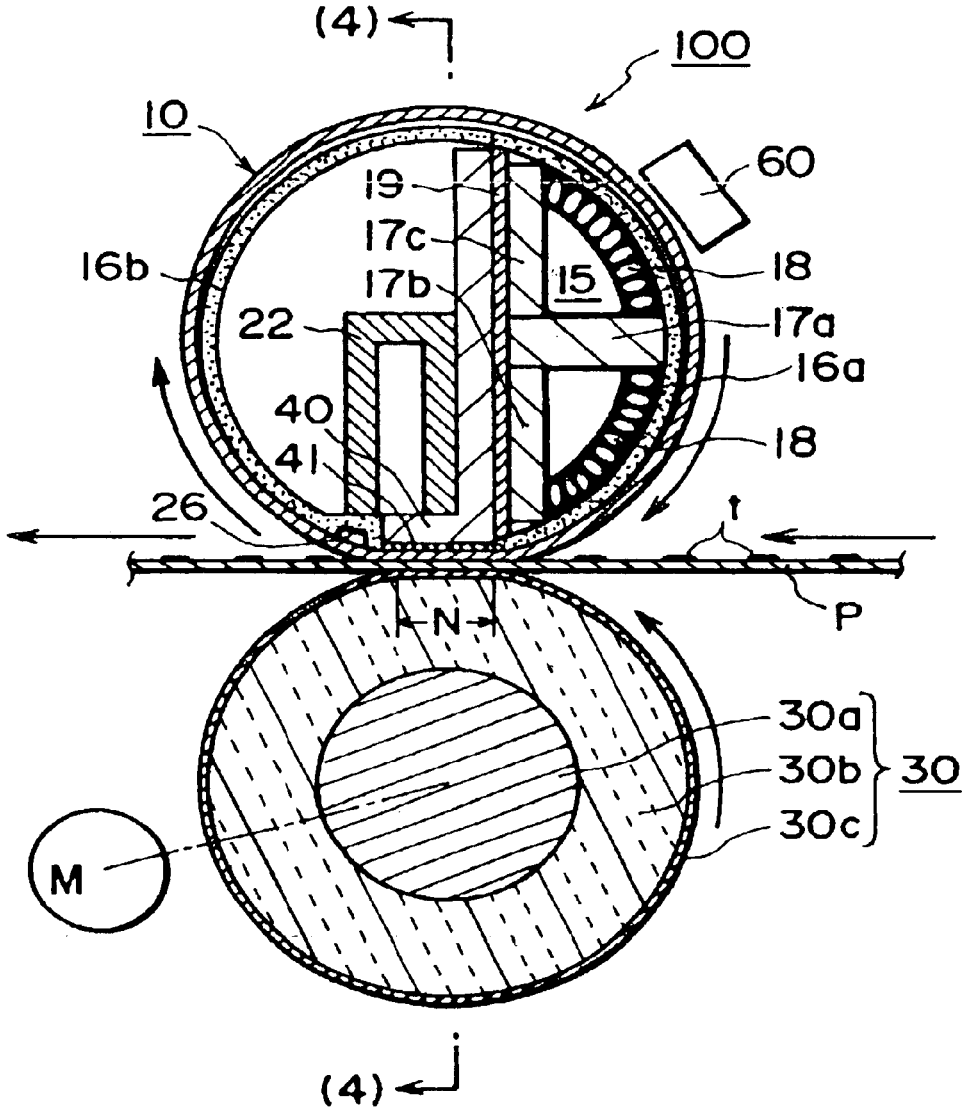
FIG. 2 is a schematic sectional view of the essential portion of the fixing apparatus in the first embodiment of the present invention, at a plane perpendicular to the axial line of the pressure roller of the fixing apparatus.
Figure 3:
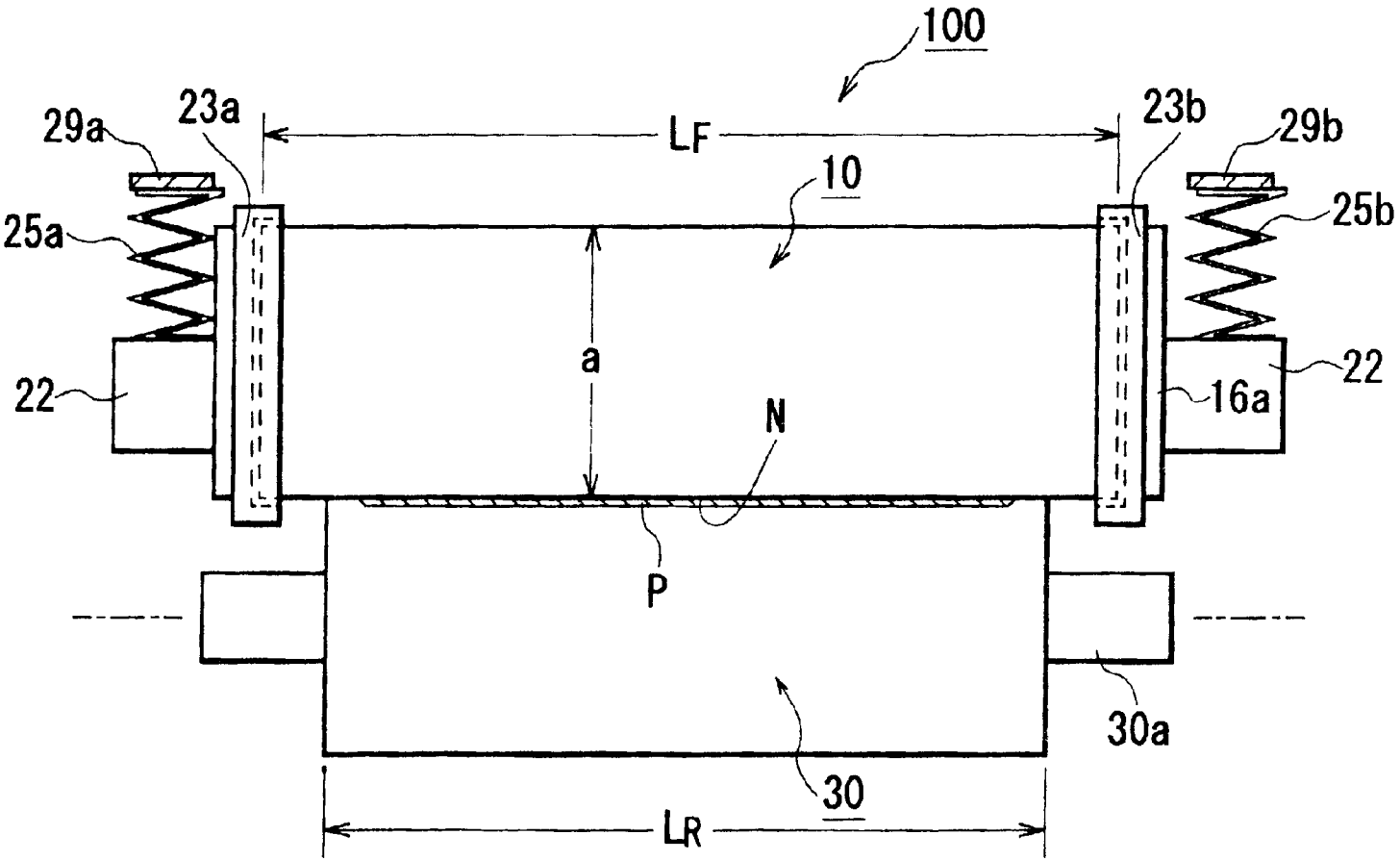
FIG. 3 is a schematic drawing of the essential portion of the fixing apparatus in the first embodiment, as seen from the front side of the apparatus.
Figure 4:
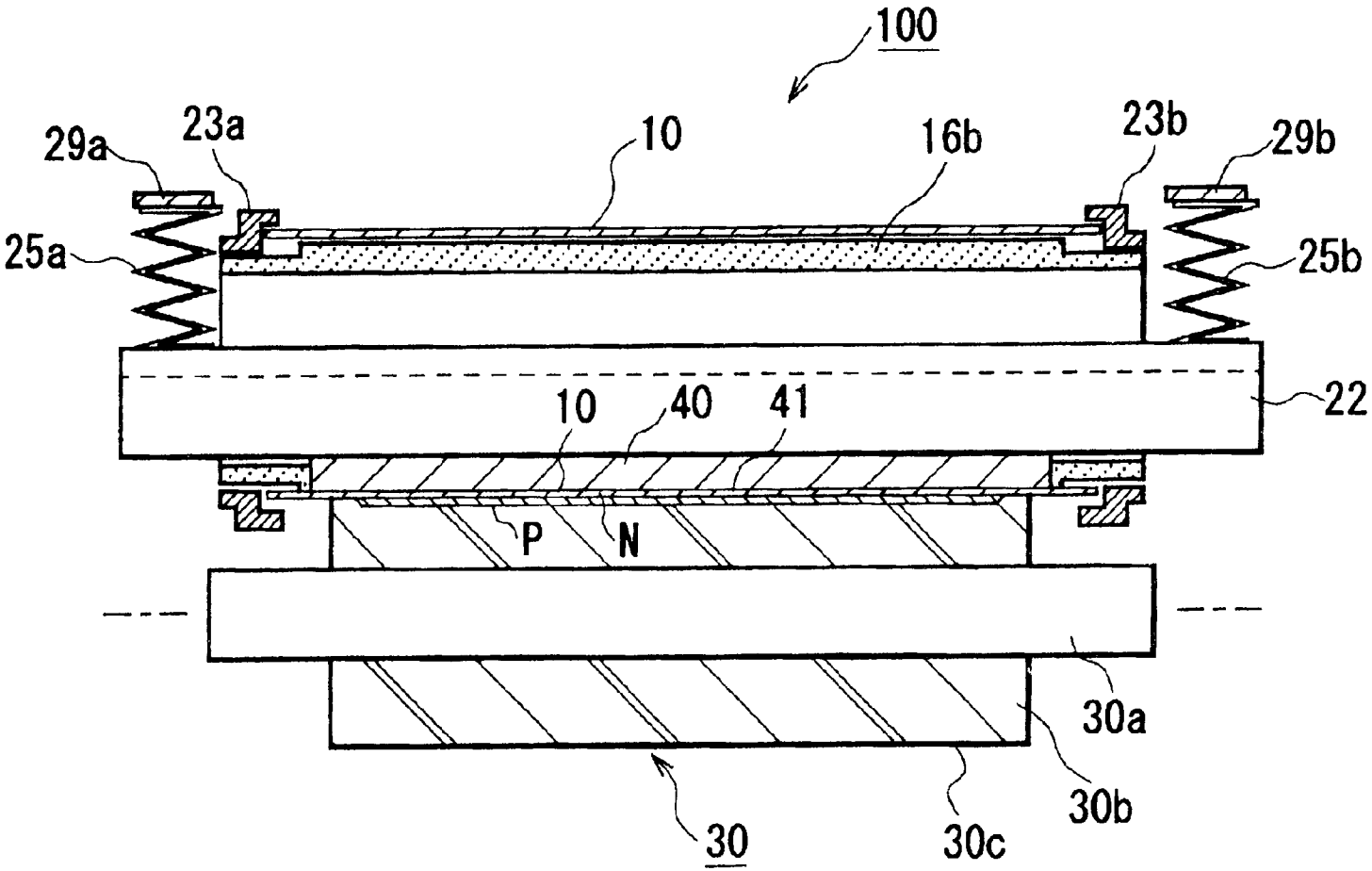
FIG. 4 is a vertical sectional view of the essential portion of the fixing apparatus in the first embodiment, at the vertical plane inclusive of the axial line of the pressure roller of the fixing apparatus.

The fixing apparatus 100 in this embodiment is of an electromagnetic induction heating type. FIG. 2 is a schematic sectional view of the essential portion of the fixing apparatus 100 in this embodiment, at a vertical plane perpendicular to the axial line of the pressure roller of the fixing apparatus 100. FIG. 3 is a schematic front view of the essential portion of the fixing apparatus 100. FIG. 4 is a schematic sectional view of the essential portion of the fixing apparatus 100, at the vertical plane inclusive of the axial line of the pressure roller of the fixing apparatus 100 (plane (4)—(4) in FIG. 2).

Figure 20:
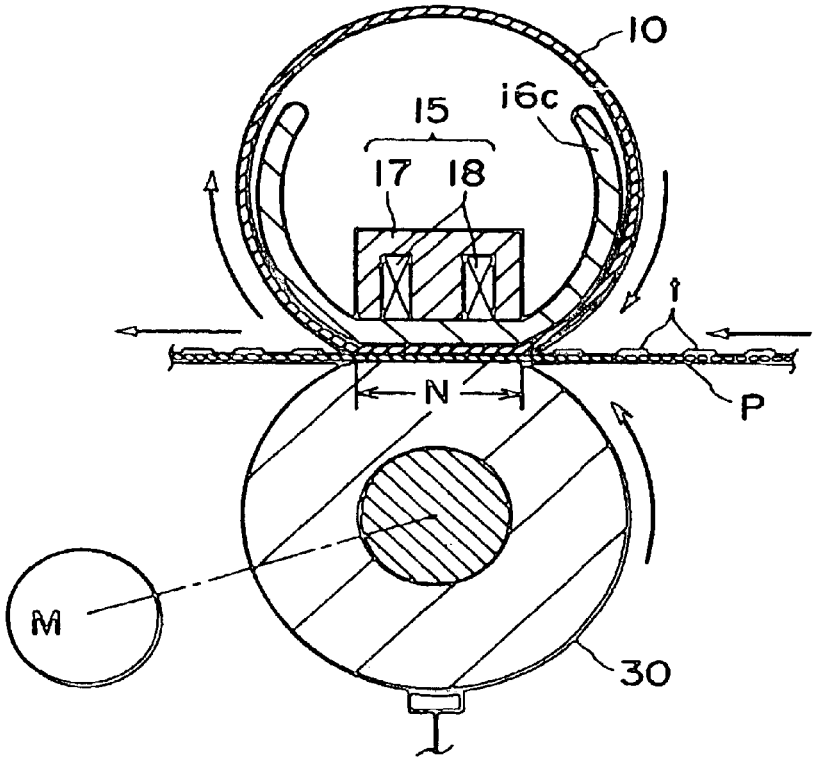
FIG. 20 PRIOR ART
FIG. 20 is a schematic sectional view of the essential portion of a fixing apparatus in accordance with the prior arts.
Figure 21:
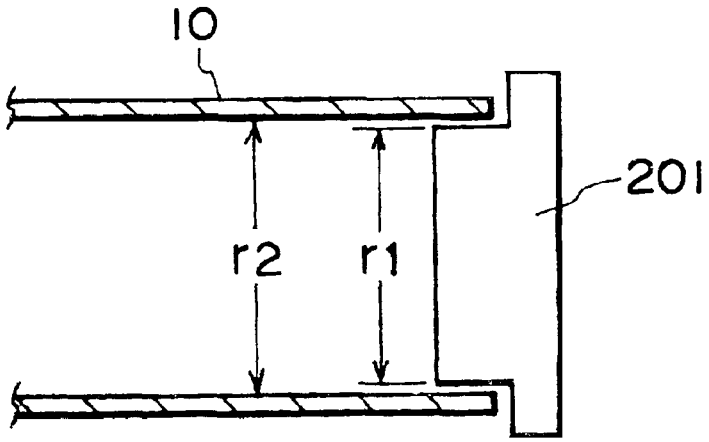
FIG. 21 is a schematic drawing for showing the relationship (1) between the sleeve and the sleeve end flange.

This apparatus 100 is similar to the fixing apparatus shown in FIG. 20. In other words, it is of a pressure roller driving type and also, of an electromagnetic induction heating type, and employs, as a rotational fixing member (fixing sleeve), a cylindrical electromagnetic induction heating sleeve formed of film. The structural members and portions of this fixing apparatus 100 identical in function to those of the apparatus shown in FIG. 20 will be given the same referential codes as the referential codes given to those of the apparatus shown in FIG. 20, in order to avoid the repetition of the same descriptions.

A magnetic field generating means 15 comprises magnetic cores 17*a*, 17*b*, and 17*c*, and an exciting coil 18.

The magnetic cores 17*a*, 17*b*, and 17*c* need to be high in permeability. Therefore, they are desired to be formed of such material as ferrite or permalloy that is used as the material for a transformer core, preferably, such ferrite that is relatively small in loss even in a frequency range of no less than 100 kHz.

The power supplying portions 18*a* and 18*b* (FIG. 5) of the exciting coil 18 are connected to an exciting circuit 27, which is enabled to generate high frequency alternating current, the frequency of which is in a range of 20 kHz to 500 kHz, with the use of a switching power source.

As the alternating current (high frequency current) is supplied to the exciting coil 18 from the exciting circuit 27, the exciting coil 18 generates an alternating magnetic flux.

Designated by referential codes 16*a* and 16*b* are sleeve guiding members, which are in the form of a trough having a semicircular cross section. They are joined so that the open sides of the two sleeve guiding members 16*a* and 16*b* face each other, creating a virtually cylindrical guiding member. Around the thus formed cylindrical guiding member, the cylindrical and rotational electromagnetic induction heating sleeve 10, which has a length Lf of 283 mm and an external diameter a of 34 mm, is loosely fitted.

The sleeve guiding member 16*a* internally holds the magnetic cores 17*a*, 17*b*, and 17*c*, and exciting coil 18, as the components of the magnetic field generating means 15.

The sleeve guiding member 16*a* also internally holds a highly heat conductive member 40 relatively high in thermal conductivity (which hereinafter will be referred to as a highly heat conductive member 40). The highly heat conductive member 40 is disposed inside the loop of the sleeve 10, and squarely faces the portion of the pressure roller 30 in the fixing nip N. It also functions as a member for backing up the sleeve 10 from inside the loop of the sleeve 10.

In this embodiment, aluminum plate with a thickness of 1 mm is used as the material for the highly heat conductive member 40.

In order to prevent the highly heat conductive member 40 from being affected by the magnetic field generated by the magnetic field generating means comprising the exciting coil 18 and magnetic cores 17*a*, 17*b*, and 17*c*, the highly heat conductive member 40 is disposed outside the magnetic field.

A referential code 22 designates a rigid pressure application stay disposed also within the virtually cylindrical sleeve guiding member made up of the sleeve guiding members 16*a* and 16*b*. The rigid pressure application stay 22 is placed in contact with the highly heat conductive member 40, on the surface opposite to the surface in contact with the portion of the internal surface correspondent to the nip N, and also in contact with the inwardly facing flat surface of the sleeve guiding member 16*b*. It extends in the direction parallel to the lengthwise direction of the sleeve 10.

A referential code 19 designates an insulating member for insulating between the combination of the magnetic cores 17*a*, 17*b*, and 17*c* and exciting coil 18, and the rigid pressure application stay 22.

Flanges 23*a* and 23*b* (FIGS. 3 and 4) are rotationally attached to the lengthwise ends, one for one, of the assembly made up of the sleeve guiding members 16*a* and 16*b*, while being regulated in terms of their movements in the lengthwise direction of the sleeve 10. While the sleeve 10 is rotated, the flanges 23*a* and 23*b* catch the sleeve 10 by its edges, regulating thereby the movement of the sleeve 10 in the direction parallel to the lengthwise direction of the sleeve 10. The flanges 23*a* and 23*b* will be described in more detail later.

The pressure roller 30 as a pressure applying member comprises: a metallic core 30*a*; a heat resistant elastic layer 30*b* coaxially formed around the metallic core; and a release layer 30*c* as a surface layer (approximately 10 $\mu$m–100 $\mu$m thick). The elastic layer is formed of heat resistant substance such as silicone rubber, fluorinated rubber, fluorinated resin, or the like, and the release layer 30*c* is formed of fluorinated resin such as PFA, PTFE, FEP, or the like. The pressure roller 30 is rotationally supported between the side plates of the unshown chassis of the fixing apparatus; the lengthwise ends of the metallic core 30*a* are supported by the bearings attached to the side plates of the unshown chassis of the fixing apparatus. In this embodiment, a pressure roller 30 which is 250 mm in the pressure application range length LR and 20 mm in external diameter, was employed. The full length LF of the sleeve 10 is greater than the pressure application range length LR of the pressure roller 30.

The rigid pressure application stay 22 is kept pressed downward by placing compressed compression springs 25*a* and 25*b* between the lengthwise end of the rigid pressure application stay 22 and the spring seats 29*a* and 29*b* of the fixing apparatus chassis, one for one. With the provision of this structural arrangement, the downwardly facing surface of the portion of the highly heat conductive member 40, correspondent to the nip N, is pressed upon the upwardly facing portion of the peripheral surface of the pressure roller 30, with the interposition of the fixing sleeve 10, forming the fixing nip N with a predetermined width.

In this embodiment, the pressure (linear pressure) generated in the nip N by the pressure roller 30 was set to approximately 7.8 N/cm (800 g/cm).

In order to maintain the width of the nip N at a certain value, it is not desirable that the hardness of the pressure roller 30 is greater than a certain value. More concretely, in order to maintain the width of the nip N at a desired value, the hardness of the pressure roller 30 is desired to be no more than 75 degrees, whereas from the standpoint of mechanical strength of the pressure roller 30, the hardness of the pressure roller 30 is desired to be no more than approximately 45 degrees (Asker hardness scale C; measured with the application of 9.8N (1 kg) to the surface layer of the pressure roller).

In this embodiment, the hardness of the pressure roller 30 was set to approximately 56 degrees, forming the fixing nip N with a width of approximately 7 mm in terms of the transfer medium conveyance direction.

The pressure roller 30 is rotationally driven by a driving means M in the counterclockwise direction indicated by an arrow mark. As the pressure roller 30 is rotationally driven, the sleeve 10 is rotated around the sleeve guiding members 16*a* and 16*b* by the friction between the peripheral surface of the pressure roller 30 and the sleeve 10, in the clockwise direction indicated by an arrow mark, at a peripheral velocity virtually equal to the peripheral velocity of the pressure roller 30, with the inwardly facing surface of the sleeve 10 sliding on the bottom surface of the highly heat conductive member 40, in the fixing nip N.

In order to reduce the friction between the bottom surface of the highly heat conductive member 40 and the internal surface of the sleeve 10 in the fixing nip N, lubricant such as heat resistant grease may be placed between the bottom surface of the highly heat conductive member 40 and the internal surface of the sleeve 10, or the bottom surface of the highly heat conductive member 40 may be covered with a lubricous member 41 to allow the sleeve 10 to more smoothly slide on the highly heat conductive member 40 in the nip N. This is done for preventing the following problem: when substance such as aluminum, which is not lubricous, is used as the material for the highly heat conductive member 40, or when the process for finishing the highly heat conductive member 40 is simplified, it is possible that as the sleeve 10 slides on the highly heat conductive member 40, the highly heat conductive member 40 will damage the sleeve 10, adversely affecting the durability of the sleeve 10.

The highly heat conductive member 40 member is effective to make uniform the heat distribution in terms of the lengthwise direction. For example, when a small sheet of paper is passed as the transfer medium P (recording medium) through the fixing apparatus, the heat in the portions of the sleeve 10 outside the path of the small sheet of paper is efficiently conducted, in the lengthwise direction of the conductive member 40, to the portion of the conductive member 40 correspondent to the path of the small sheet of paper, reducing the electrical power consumed when a small sheet of paper is passed through the fixing apparatus.

Figure 5:
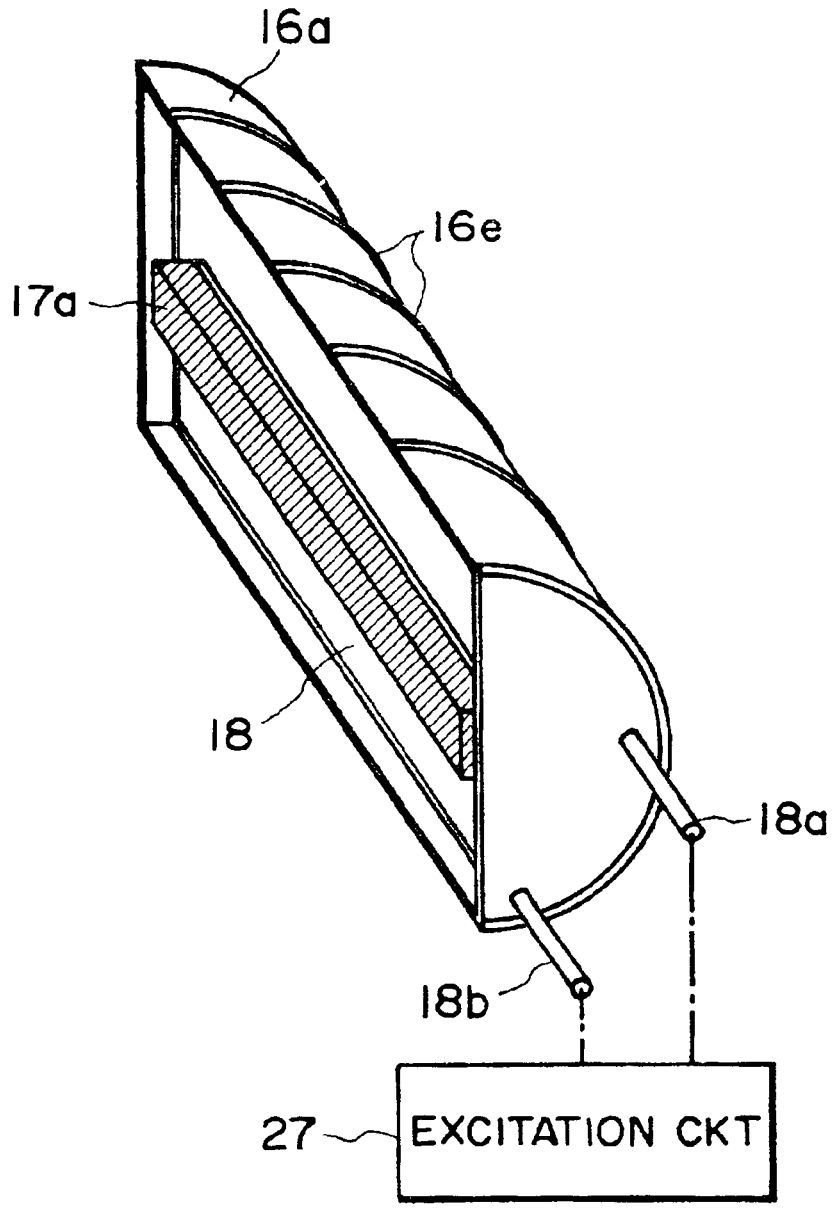
FIG. 5 is a perspective schematic view of the magnetic field generating portion of the fixing apparatus in the first embodiment.

Referring to FIG. 5, in order to reduce the load which applies to the sleeve 10 as the sleeve 10 is rotated, the peripheral surface of the sleeve guiding member 16*a* is provided with a plurality of ribs 16*e*, which extend perpendicular to the lengthwise direction of the sleeve guiding member 16*a*, following the curvature, and are evenly distributed in the lengthwise direction of the sleeve guiding member 16*a*, with the provision of predetermined intervals, for reducing the friction which occurs between the peripheral surface of the sleeve guiding member 16*a* and the internal surface of the sleeve 10 as the sleeve 10 slides on the sleeve guiding member 16*a*. The sleeve guiding member 16*b* may also be provided with a plurality of ribs such as those provided on the peripheral surface of the sleeve guiding member 16*a*.

Figure 6:
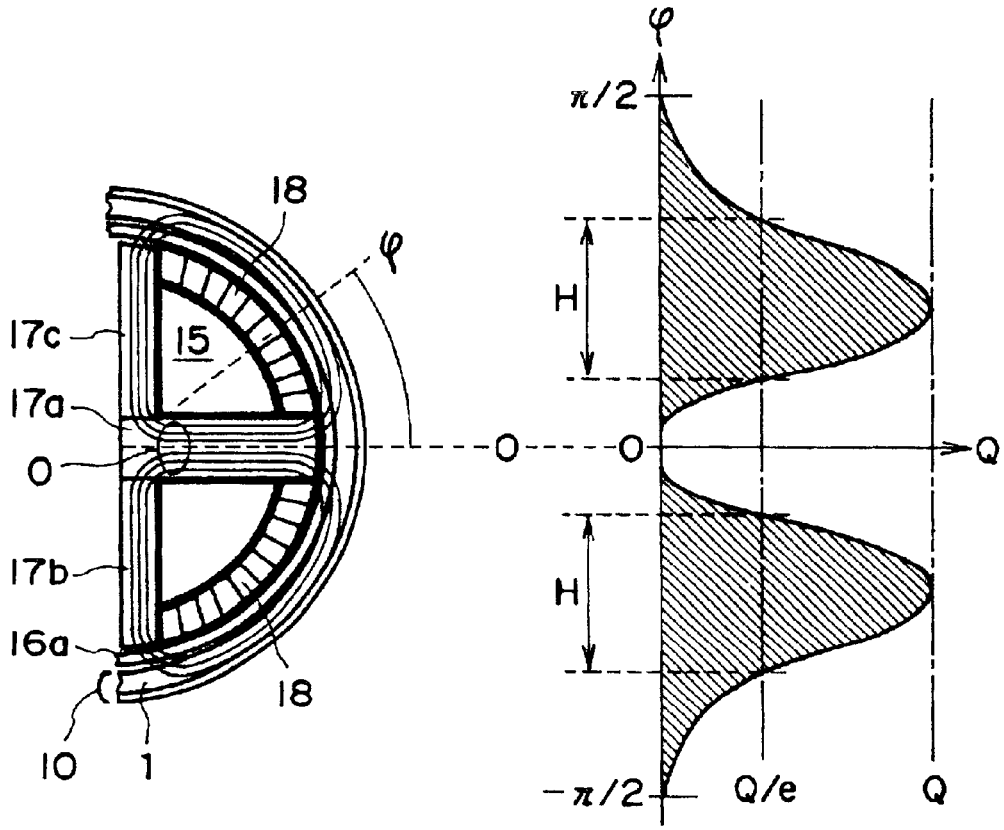
FIG. 6 is a schematic drawing for showing the characteristics of the alternating magnetic field generated by the magnetic field generating portion of the fixing apparatus in the first embodiment.

FIG. 6 is a schematic drawing for showing the characteristics of the alternating magnetic flux. A magnetic flux C in the drawing represents a portion of the alternating magnetic flux generated by the magnetic field generating means.

Being guided by the magnetic cores 17*a*, 17*b*, and 17*c*, the alternating magnetic flux C induces eddy currents in the electromagnetic induction based heat generating layer 1 of the sleeve 10, between the magnetic cores 17*a* and 17*b*, and between the magnetic cores 17*a* and 17*c*. These eddy currents generate heat (Joule heat, or eddy current loss) in the electromagnetic induction based heat generating layer 1, in cooperation with the specific resistance of the electromagnetic induction based heat generating layer 1.

The amount Q of the heat generated in the electromagnetic induction based heat generating layer 1 is determined by the density of the magnetic flux which passes through the electromagnetic induction heat generating layer 1, and the heat distribution is as depicted by the graph in FIG. 6. In the graph, the axis of abscissas stands for the position of a given point of the sleeve 10 represented in the angle $\phi$ between the line connecting the given point of the sleeve 10 and the center of the inward surface of the magnetic core 17*a*, and the line connecting the centers of the inward and outward surfaces of the magnetic core 17*a*, whereas the axis of ordinates stands for the amount Q of the heat generated in the electromagnetic induction heat generating layer 1 of the sleeve 10. The heat generating ranges H in the graph are the ranges in which heat is generated by no less than Q/e in the electromagnetic induction heat generating layer 1; in other words, they are the ranges in which heat is generated in the electromagnetic induction heat generating layer 1 by the amount sufficient for image fixation.

The temperature of the fixing nip N is kept at a predetermined level; the electric current supplied to the exciting coil 18 is controlled by a temperature control system inclusive of a temperature detecting means 26 (FIG. 2).

The temperature detecting means 26 is a temperature sensor, such as a thermistor, for detecting the temperature of the sleeve 10. In this embodiment, the temperature of the fixing nip portion N is controlled based on the temperature measured by the temperature sensor 26.

As an image forming apparatus is turned on, the sleeve 10 begins to be rotated, and electrical power is supplied to the exciting coil 18 from the exciting circuit 27. As a result, the temperature of the fixing nip portion N is raised to the predetermined level by the heat electromagnetically generated in the sleeve 10. In this state, the transfer medium P, which has been conveyed from the image forming portion after the formation of an unfixed toner image t on the transfer medium P, is introduced into the fixing nip portion N, that is, the interface between the sleeve 10 and pressure roller 30, with the image bearing surface of the transfer medium P facing upward, in other words, facing the sleeve 10. Then, the transfer medium P is conveyed with the sleeve 10 through the fixing nip portion N, the image bearing surface of the transfer medium P being kept perfectly in contact with the peripheral surface of the sleeve 10, by the pressure roller 30.

While the transfer medium P is conveyed with the sleeve 10 through the fixing nip portion N, being sandwiched by the sleeve 10 and pressure roller 30, the unfixed toner image t on the transfer medium P is thermally fixed to the transfer medium P.

After being passed through the fixing nip portion N, the transfer medium P is released from the peripheral surface of the sleeve 10, and is conveyed further to be discharged from the image forming apparatus.

After being thermally fixed to the transfer medium P while the transfer medium P is passed through the fixing nip portion N, the toner image cools down to become a permanent toner image.

In this embodiment, the fixing apparatus is provided with a thermo-switch 60 as a temperature detecting element for shutting off the power supply to the exciting coil 18 if the fixing apparatus goes out of control. The thermo-switch 60 is disposed adjacent to the portion of the sleeve 10 in one of the heat generating ranges H, as shown in FIG. 2.

Figure 7:
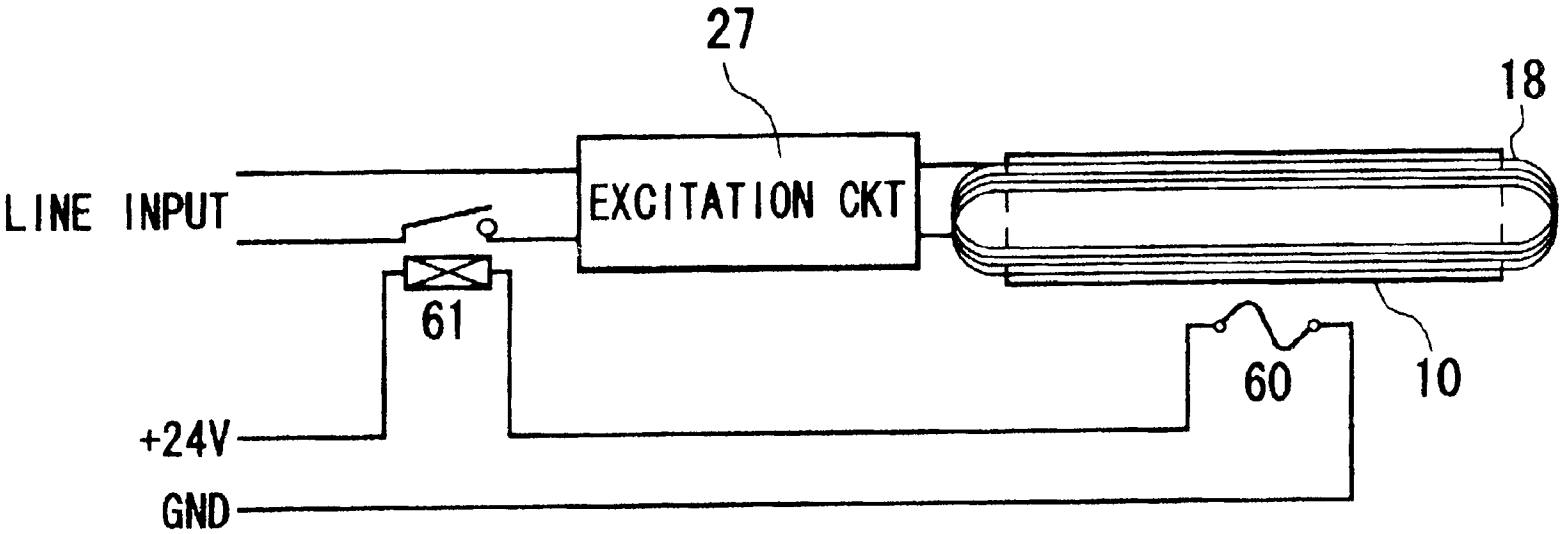
FIG. 7 is a diagram of the safety circuit.

FIG. 7 is the diagram for the safety circuit used in this embodiment. The thermo-switch 60 as a temperature detecting element is connected in series with a 24 V DC power source and a relay switch 61. The turn-off of the thermo-switch 60 immediately shuts off the power supply to the relay switch 61, turning off the relay switch 61. The turn-off of the relay switch 61 shuts off the power supply to the exciting circuit 27, which in turn shuts off the power supply to the exciting coil 18. The thermo-switch 60 in this embodiment was set up so that it would turn off at 220° C.

As described above, the thermo-switch 60 is disposed adjacent to the portion of the sleeve 10 in one of the heat generating ranges H, with no contact between the thermo-switch 60 and the peripheral surface of the sleeve 10. The distance between the thermo-switch 60 and sleeve 10 in this embodiment was set to approximately 2 mm. This provision can prevent the sleeve 10 from being damaged by the contact between the sleeve 10 and thermo-switch 60; it can prevent the fixing performance of the fixing apparatus from drastically deteriorating with the elapse of time.

In the case of the above described fixing apparatus shown in FIG. 20, heat is generated in the fixing nip N. In comparison, in the case of the fixing apparatus in this embodiment, which is different in structure from the fixing apparatus shown in FIG. 20, heat is not generated in the fixing nip N. Thus, even if the fixing apparatus in this embodiment goes out of control and keeps on supplying the exciting coil 18 with power, generating therefore heat in the sleeve 10, while the fixing apparatus is stuck, with a sheet of paper P (transfer medium) remaining pinched in the fixing nip portion N, it does not occur that the sheet of paper P stuck in the fixing nip portion N is directly heated, because heat is not generated in the fixing nip portion N in which the sheet of paper P is stuck. Further, the thermo-switch 60 is disposed adjacent to the portion of the sleeve 10 in one of the ranges H in which a relatively large amount of heat is generated. Therefore, as soon as the temperature of the portion of the sleeve 10 in the heat generating range H reaches 220° C., this temperature is sensed by the thermo-switch 60, and the thermo-switch 60 turns itself off, shutting off the power supply to be supplied to the exciting coil 18 through the relay switch 61.

Since the ignition temperature of paper is approximately 400° C., the thermo-switch 60 in this embodiment can stop the heat generation in the sleeve 10, without allowing the sheet of paper in the fixing nip portion N to ignite. Incidentally, in place of the thermo-switch 60, a thermal fuse may be used as a temperature detecting element.

In this embodiment, toner t which contains such substances that soften at a relatively low temperature, was used as developer. Therefore, the fixing apparatus is not provided with an oil coating mechanism for preventing off-set.

B) Exciting Coil 18

As for the assembly of the exciting coil 18, first, a plurality of fine copper wires which were individually coated with insulating material, were bundled. Then, the exciting coil 18 was formed by winding, a predetermined number times, the bundle of the plurality of fine copper wire coated with the insulating material. In this embodiment, the bundle was wound 10 times to form the exciting coil 18.

In consideration of the heat generated in the sleeve 10 and the thermal conductivity, a heat resistant substance such as amide-imide, polyimide, or the like, should be used as the material for the insulation for the fine copper wires.

The wire density of the exciting coil 18 may be increased by the application of external pressure.

Referring to FIGS. 2 and 6, the exciting coil 18 is wound so that its shape conforms to the curvature of the heat generating layer 1 of the sleeve 10. In this embodiment, a structural arrangement was made so that the distance between the heat generating layer 1 of the sleeve 10 and the exciting coil 18 became approximately 2 mm.

The material for the sleeve guiding member 16*a* and 16*b* (exciting coil holding members) is desired to be superior in insulative property and heat resistance; for example, phenol resin, fluorinated resin, polyimide resin, polyamide resin, polyamide-imide resin, PEEK resin, PES resin, PPS resin, PFA resin, PTFE resin, FEP resin, LCP resin, or the like.

The smaller the distances between the magnetic cores 17*a*, 17*b*, and 17*c* and the sleeve 10, and between the exciting coil 18 and the sleeve 10, the higher the magnetic flux absorption efficiency. If these distances exceed 5 mm, the efficiency drastically drops. Therefore, a structural arrangement should be made so that the distances become no more than 5 mm. Further, the distance between the sleeve 10 and exciting coil 18 does not need to be uniform as long as the distance is no more than 5 mm.

Each of the lead lines, or the power supplying portion 18*a* and 18*b* (FIG. 5), of the exciting coil 18 extended through the sleeve guiding member 16*a* are covered with insulative coat; the bundle of fine copper wires is covered with a single piece of coat.

C) Sleeve 10

Figure 8A:
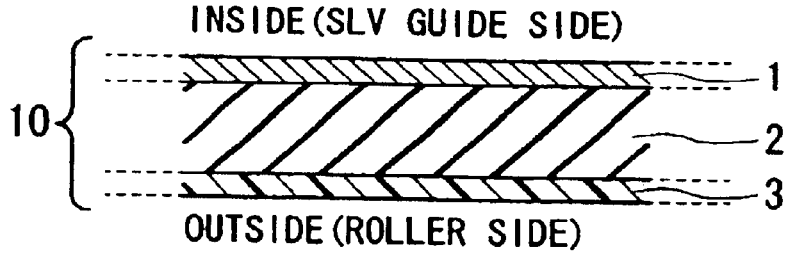
FIGS. 8(*a*) and 8(*b*) are schematic sectional views of the sleeve of the fixing apparatus in the first embodiment, and show the structure thereof.
Figure 8B:
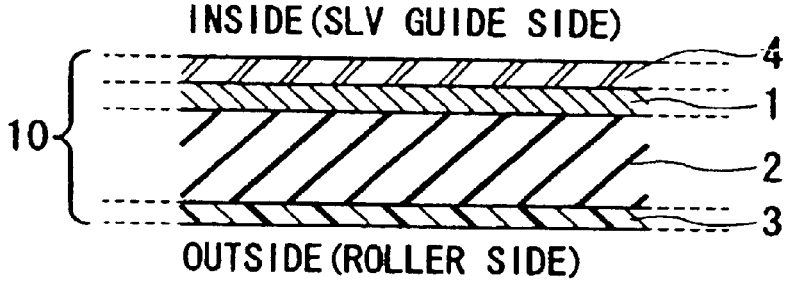

FIG. 8(*a*) is a schematic sectional view of the sleeve 10 in this embodiment, and shows the laminar structure thereof. The sleeve 10 in this embodiment is a compound sleeve made up of the heat generating layer 1, elastic layer 2, and release layer 3. The heat generating layer 1 also functions as the base layer of the sleeve 10 based on the electromagnetic induction heat generation, and is formed of metallic material. The elastic layer 2 is layered upon the outwardly facing surface of the heat generating layer 1, and the release layer 3 is layered upon the outwardly facing surface of the elastic layer 2.

In order to adhere the heating layer 1 and elastic layer 2 to each other, and the elastic layer 2 and release layer 3 to each other, a primer layer (unshown) may be placed between the heating layer 1 and elastic layer 2, and between the elastic layer 2 and release layer 3.

The heat generating layer 1 of the virtually cylindrical sleeve 10 is the most inward layer, and the release layer 3 is the most outward layer. As described above, as the alternating magnetic flux acts on the heat generating layer 1, eddy current is induced in the heat generating layer 1, and this eddy current generates heat in the heat generating layer 1, heating the sleeve 10. This heat conducts to the outwardly facing surface of the sleeve 10 through the elastic layer 2 and release layer 3, and heats the transfer medium P, as a medium to be heated, which is being passed through the fixing nip portion N. As a result, the unfixed toner image is fixed to the transfer medium P.

a. Heat Generating Layer 1

As for the material for the heat generating layer 1, a ferromagnetic substance such as nickel, iron, ferromagnetic SUS, or nickel-cobalt alloy is desirable.

Nonmagnetic substance is also usable as the material for the heat generating layer 1, but a metal such as nickel, iron, magnetic stainless steel, or nickel-cobalt alloy, which is superior in magnetic flux absorbency is preferable.

The thickness of the heat generating layer 1 is desired to be no less than the penetration depth σ (mm) obtained by the following equation, and no more than 200 μm:

$$\sigma=503\times(\rho/f\mu)^{1/2}$$

f: frequency (Hz) of exciting circuit 27

μ: magnetic permeability

ρ: specific resistivity.

Figure 9:
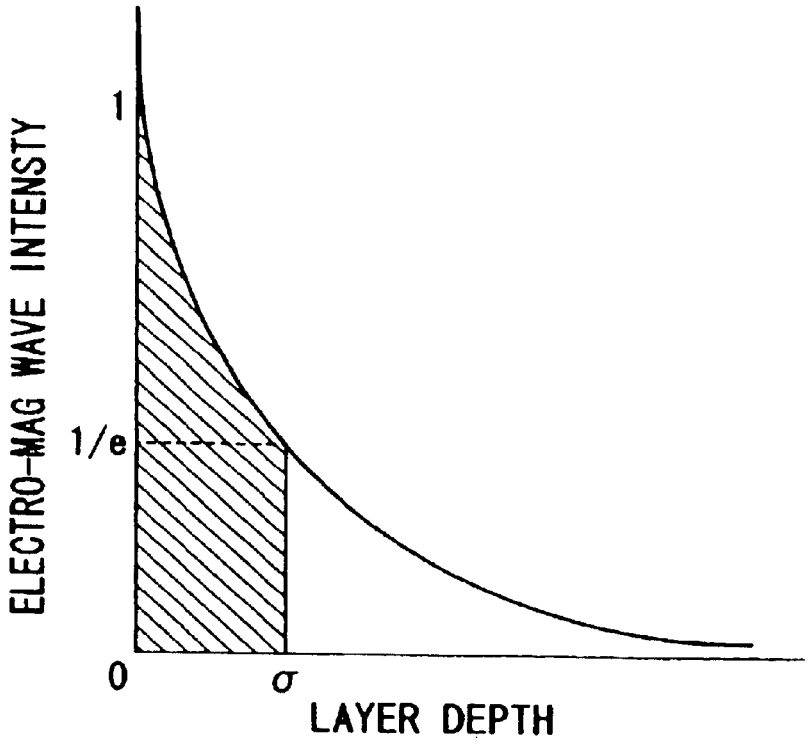
FIG. 9 is a graph for showing the relationship between the thickness of the heat generating layer and the strength of the electromagnetic wave.

This shows the depth level to which the electromagnetic wave used for electromagnetic induction reaches. At a point deeper than the depth level obtained by the above equation, the strength of the electromagnetic wave is no more than 1/e. Reversely stated, most of the energy of the magnetic wave is absorbed before the magnetic wave reaches this depth level (FIG. 9).

The thickness of the heat generating layer 1 is desired to be 1–100 μm, preferably, 20–100 μm. If the thickness of the heat generating layer 1 is no more than 1 μm, most of the electromagnetic energy fails to be absorbed by the heat generating layer 1; efficiency is low. Further, from the standpoint of mechanical strength, the thickness of the heat generating layer 1 is desired to be no less than 20 μm.

On the other hand, if the thickness of the heat generating layer 1 exceeds 100 μm, the heat generating layer 1 becomes too rigid, in other words, inferior in flexibility, which makes it impractical for the heat generating layer 1 to be a part of the flexible rotational member. Thus, the thickness of the heat generating layer 1 is desired to be 1–100 μM, preferably, in a range of 20–100 μm, in consideration of the mechanical strength. In this embodiment, 50 μm thick nickel film formed by electroplating was used as the material for the heat generating layer 1.

b. Elastic Layer 2

The material for the elastic layer 2 is such substances as silicone rubber, fluorinated rubber, fluoro-silicone rubber, and the like, that are superior in heat resistance and thermal conductivity.

The elastic layer 2 is important for preventing minute mosaic defects from being formed in an image during fixation. In other words, with the provision of the elastic layer 2, the release layer 3, that is, the surface layer, of the sleeve 10 is enabled to press on the toner particles on the transfer medium P, in the least disturbing manner, preventing the sleeve 10 from causing anomalies in an image during fixation.

Thus, in terms of the hardness in JIS-A, in other words, the hardness measured with the use of an A-type hardness gauge (JIS-K6301), it is necessary for the material (rubber) for the elastic layer 2 to be no more than 30 degrees, preferably, no more than 25 degrees. As for the thickness, it is necessary for the elastic layer 2 to be no less than 50 μm, preferably, no less than 100 μm.

If the thickness of the elastic layer 2 exceeds 500 μm, the elastic layer 2 becomes excessive in thermal resistance, making it difficult to give the fixing apparatus "quick start" capability (almost impossible if the thickness is no less than 1,000 μm). Thus, the thickness of the elastic layer 2 is desired to be no more than 500 μm.

The thermal conductivity λ of the elastic layer 2 is desired to be in a range of $2.5\times10^{-1}$–$8.4\times10^{-1}$ [W/m/° C.] ($6\times10^{-4}$–$2\times10^{-3}$ [cal/cm.sec.deg]).

If the thermal conductivity λ is smaller than $2.5\times10^{-1}$ [W/m/° C.] the thermal resistance of the elastic layer 2 is excessively large, delaying the temperature increase of the surface layer (release layer 3) of the sleeve 10.

On the other hand, if the thermal conductivity λ is no less than $8.4\times10^{-1}$ [W/m/° C.], the elastic layer 2 becomes excessively hard, and/or the compression set of the elastic layer 2 worsens.

Thus, the thermal conductivity λ is desired to be in the range of $2.5\times10^{-1}$–$8.4\times10^{-1}$ [W/m/° C.], preferably, $3.3\times10^{-1}$–$6.3\times10^{-1}$ [W/m/° C.] ($8\times10^{-4}$–$1.5\times10^{-3}$ [cal/cm.sec.deg]).

In this embodiment, silicone rubber which was 10 degree in hardness (JIS-A), and $4.2\times10^{-1}$ [W/m/° C.] ($1\times10^{-3}$ [cal/cm.sec.deg]) in thermal conductivity, was used to form the elastic layer 2 with a thickness of 300 μm.

c. Release Layer 3

As the material for the release layer 3, it is possible to select a substance superior in releasing ability and heat resistance, for example, fluorinated resin, silicone resin, fluoro-silicone resin, fluorinated rubber, silicone rubber, PFA, PTFE, FEP, or the like. The release layer 3 can be formed of one of these fluorinated resins, in the form of a piece of tube, or can be formed by coating (painting) one of these materials directly on the elastic layer 2.

In order to satisfactorily conduct the softness of the elastic layer 2 to the surface of the sleeve 10, the thickness of the release layer 3 must be no more than 100 μm, preferably, no more than 80 μm. If the thickness of the release layer 3 is greater than 100 μm, the sleeve 10 fails to press on the toner particles on the transfer medium P in the least disturbing manner, resulting in the formation of an image having anomalies across its solid areas.

Further, the thinner the elastic layer 2, the smaller the maximum value for the thickness of the release layer 3 must be. According to the results of the studies carried out by the applicants of the present invention, the thickness of the release layer 3 needed to be no more than ⅓ of the thickness of elastic layer 2; when it was more, the softness of the elastic layer 2 could not satisfactorily be reflected by the surface of the sleeve 10.

On the other hand, if the thickness of the release layer 3 is under 5 μm, the mechanical stress to which the elastic layer 2 is subjected cannot be cushioned by the release layer 3, which causes the elastic layer and/or release layer themselves to deteriorate. Thus, the thickness of the release layer 3 needs to be no less than 5 μm, preferably, no less than 10 μm.

In this embodiment, a piece of PFA tube with a thickness of 30 μm was used as the release layer 3.

To summarize the relationship between the thicknesses of the elastic layer 2 and release layer 3, it is desired that there is the following relationship between the thickness of the elastic layer 2 and release layer 3:

$50\ \mu m \leqq t1 \leqq 500\ \mu m$ $5\ \mu m \leqq t2 \leqq 100\ \mu m$, and $t1 \geqq 3\times t2$ t1: thickness of elastic layer 2 t2: thickness of release layer 3.

d. Heat Insulating Layer 4

Regarding the structure of the sleeve 10, the sleeve 10 may be provided with a heat insulating layer 4, which is layered on the sleeve guiding member side (side opposite to where elastic layer 2 is layered) of the heat generating layer 1, as shown in FIG. 8(*b*).

As for the material for the heat insulating layer 4, heat resistant substance is desirable: for example, fluorinated resin, polyimde resin, polyamide resin, polyamide-imide resin, PEEK resin, PES resin, PPS resin, PFA resin, PTFE resin, or FEP resin.

The thickness of the heat insulating layer 4 is desired to be 10–1,000 μm. If it is no more than 10 μm, the heat insulating layer 4 is not effective as a heat insulating layer, and also, lacks durability. On the other hand, if the thickness of the heat insulating layer 4 exceeds 1,000 μm, the distances from the magnetic cores 17*a*, 17*b*, and 17*c*, to the heat generating layer 1, and the distance from the exciting coil 18 to the heat generating layer 1 become too large for a sufficient amount of the magnetic flux to be absorbed by the heat generating layer 1.

With the provision of the heat insulating layer 4, the heat generated in the heat generating layer 1 is prevented from conducting inward of the sleeve 10. Therefore, the heat generated in heat generating layer 1 is conducted to the transfer medium P at a ratio higher than without the heat insulating layer 4, reducing thereby power consumption.

D) Sleeve End Flange 23(*a, b*)

Next, the sleeve end flange 23(*a, b*) will be described. FIGS. 10–14 show the deformation of the sleeve 10, which occurs as the sleeve 10 is subjected to pressure.

The sleeve end flange 23 in this embodiment has the function of regulating the movement of the sleeve 10 in the direction parallel to the lengthwise direction (generatrix) of the sleeve 10, as well as the function of protecting the edge of the sleeve 10 by rotating with the sleeve 10, with virtually the entirety of the peripheral surface of the end portion of the sleeve 10 remaining in contact with (not adhered) the sleeve end flange 23. The sleeve end flange 23 is regulated by an unshown holder in terms of the aforementioned lengthwise direction of the sleeve 10.

Figure 10:
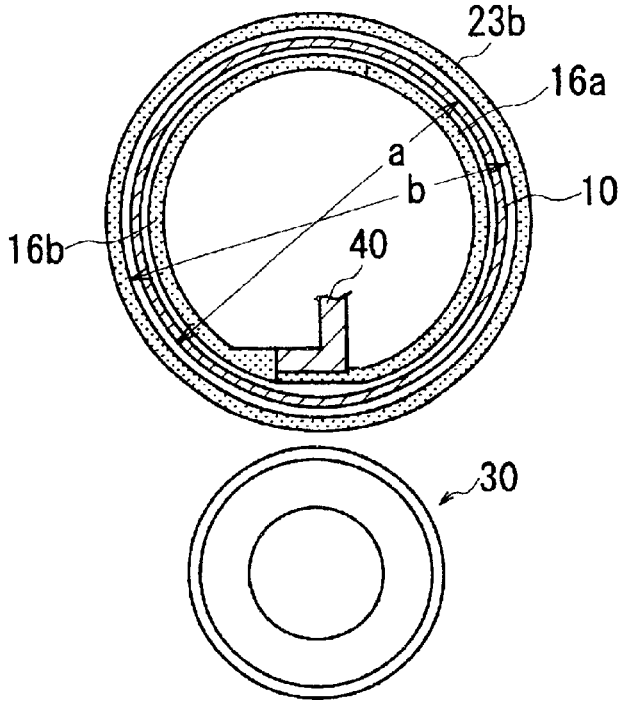
FIG. 10 is a schematic drawing for showing the relationship (1) between the sleeve and the sleeve end flange.

FIG. 10 shows the cross section of the sleeve 10 and the cross section of the portion of the flange 23 for catching the sleeve 10, when the pressure roller 30 is not pressing on the sleeve 10. As evident from the drawing, when the sleeve 10 is not under stress, the external diameter a of the sleeve 10 is 34 mm. A referential code b stands for the internal diameter of the portion of the flange 23 which fits around the end portion of the sleeve 10 (portion of the internal surface of the flange 23 which faces the peripheral surface of the end portion of the sleeve 10).

In comparison, FIGS. 11–14 show the states of the sleeve 10 and pressure roller 30, when the sleeve 10 is under the direct pressure from the pressure roller 30.

Figure 11:
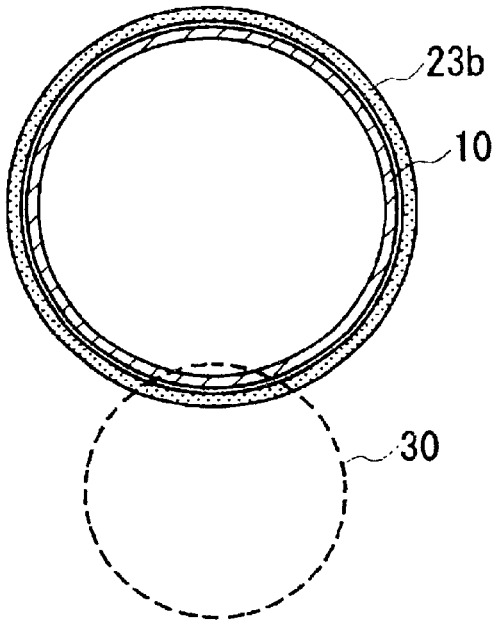
FIG. 11 is a schematic drawing for showing the relationship (2) between the sleeve and the sleeve end flange.

Referring to FIG. 11, if the internal diameter b (b>a) of the portion of the flange 23 which fits around the end portion of the sleeve 10 is too small, the end portion of the sleeve 10 is not allowed to deform in the flange 23, although the portion of the sleeve 10 in contact with the pressure roller 30, that is, the portion of the sleeve 10 pinched in the nip, is allowed to deform. Therefore, the cross section of the end portion of the sleeve 10 within the flange 23 remains in virtually the same shape as that of the flange 23, that is, circular shape. In other words, the portion of the sleeve 10, which is pinched in the nip N, becomes different in cross section from both end portions of the sleeve 10 covered by the flanges 23*a* and 23*b*, respectively. As a result, the sleeve 10 is strained.

Figure 12:
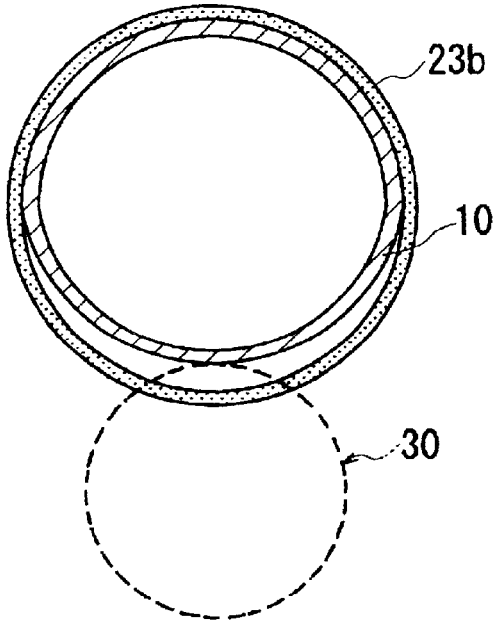
FIG. 12 is a schematic drawing for showing the relationship (3) between the sleeve and the sleeve end flange.

On the other hand, if the aforementioned internal diameter b is too large, as shown in FIG. 12, the amount of the friction between the sleeve 10 and flange 23 is too small for the sleeve to rotate the flange 23 by friction.

Figure 22:
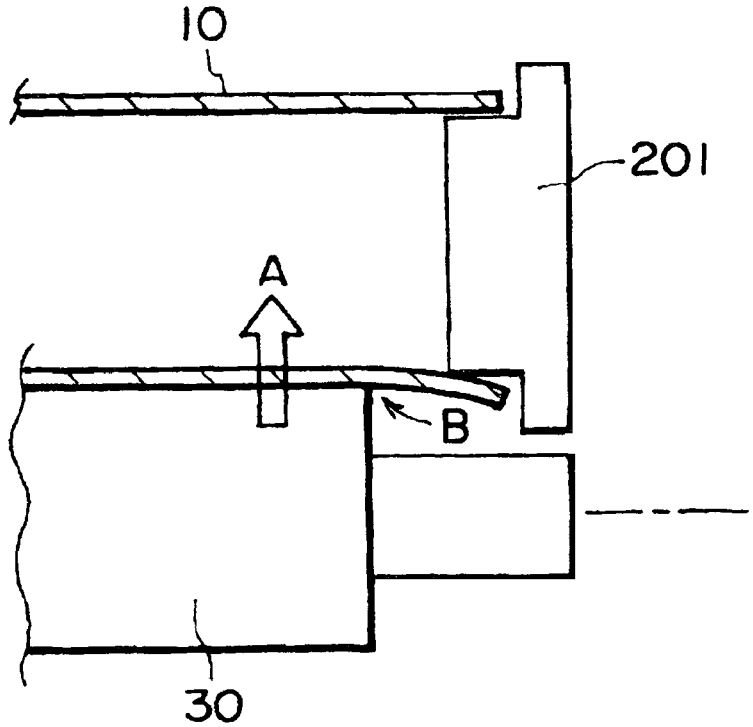
FIG. 22 is a schematic drawing for showing the relationship (2) between the sleeve and the sleeve end flange.

In the former case (FIG. 11), the border portion between the portion of the sleeve 10 fitted in the flange 23, and the portion of the sleeve 10 in contact with the pressure roller 30 (portion in the nip N), is strained, for the same reason as that given regarding the description of the fixing apparatus based on the prior arts (FIG. 22). As a result, this border portion of the sleeve 10 is severely affected by the stress caused in the sleeve 10 by the heat and pressure. Therefore, as the amount of the cumulative usage increases, the sleeve 10 breaks due to fatigue.

In comparison, in the latter case (FIG. 12), the following problems occur. That is, the sleeve 10 and flange 23 slip relative to each other, and the flange 23 (formed of heat resistant resin such as PPS, LCP, and PI) is shaved by the sleeve 10, eventually breaking, whereas the end portions of the sleeve 10 are buckled, which eventually results in the cracking of the end portions.

Figure 13:
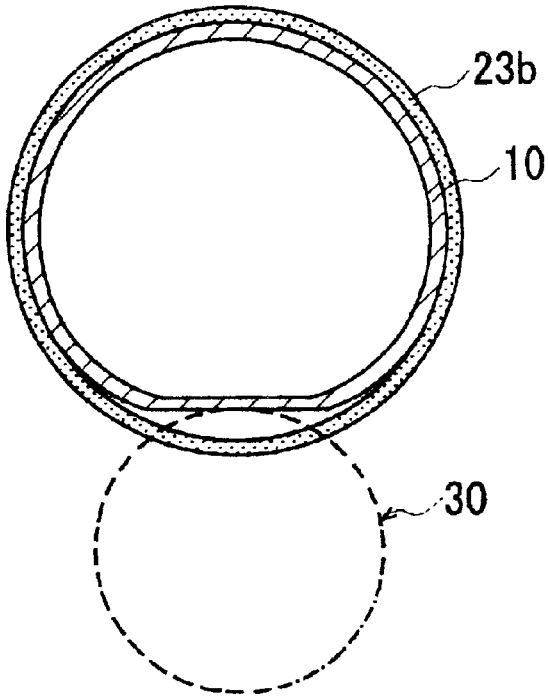
FIG. 13 is a schematic drawing for showing the relationship (4) between the sleeve and the sleeve end flange.

FIG. 13 shows the cross sectional shape of the portion of the sleeve 10 within the flange 23, when the relationship between the external diameter a and the internal diameter b of the flange 23 is proper.

The studies carried out by the inventors of the present invention made the following discoveries. In terms of the concrete values of the internal diameter b of the flange 23 and external diameter a of the sleeve 10, when the gap Δt(=b×a) between the sleeve 10 and flange 23 was no more than 0.3 mm, the end portion of the sleeve 10 was not allowed to sufficiently deform. When the gap Δt was no less than 1.0 mm, the end portion of the sleeve 10 was allowed to sufficiently deform, but the contact area between the sleeve 10 and flange 23 reduced, reducing thereby the friction between the sleeve 10 and flange 23, after the occurrence of the deformation of the sleeve 10, as shown in FIG. 12. Therefore, the sleeve 10 and flange 23 slipped relative to each other.

On the other hand, when the gap Δt was in a range of 0.3 mm–1.0 mm, the sleeve 10 was allowed to sufficiently deform within the flange 23, and also, the resiliency of the sleeve 10 generated a sufficient amount of friction between the sleeve 10 and flange 23 (FIG. 13).

It is conceivable that the optimum value of the gap Δt is dependent upon the external diameter and thickness of the sleeve 10. When a metallic sleeve (Ni, Co—Ni, Fe, Stainless Steel) with a thickness of 20 μm–100 μm and an external diameter of 25 mm–50 mm was employed as the sleeve 10, the optimum gap Δt was in a range, which satisfies the following formula:

$$0.009 \leqq \Delta t/a \leqq 0.03.$$

To sum up, the flanges 23*a* and 23*b*, the internal diameter of which were greater by a predetermined amount than the external diameter of the sleeve 10, were fitted around the end portions of the sleeve 10, one for one. Therefore, the stress, which occurred in the portions of the sleeve 10 adjacent to the nip portion, in terms of the lengthwise direction of the pressure drum 30, as the sleeve 10 was rotated, was smaller. As a result, the durability of the sleeve 10 drastically increased. In addition, the rotation of the sleeve 10 was kept stable by the flanges 23*a* and 23*b*. Therefore, the performance of the fixing apparatus remained stable.

When the inventors of the present invention tested a fixing apparatus comprising a sleeve 10, which is 34 mm in external diameter a, and flanges 23, which were 34.7 mm in the internal diameter b of its sleeve catching portion, no breakage was found in the sleeve 10 even after producing approximately 300,000 full-color prints.

For comparison, the internal diameter b of the sleeve catching portion of each flange 23 was reduced to 34.1 mm. As a result, the production of approximately 50,000 full-color prints caused cracks in the portion of the surface of the sleeve 10, outside the range of the nip formed by the pressure roller 30, in terms of the lengthwise direction of the pressure roller 30, in other words, the surface of the portion of the sleeve 10 immediately inward of the portion of the sleeve 10 fitted in the flange 23, in terms of the lengthwise direction of the pressure roller 30.

<Embodiment 2>

Next, the second embodiment of the present invention, in which the flange 23(*a, b*) has been further improved, will be described with reference to FIG. 15.

Figure 15:
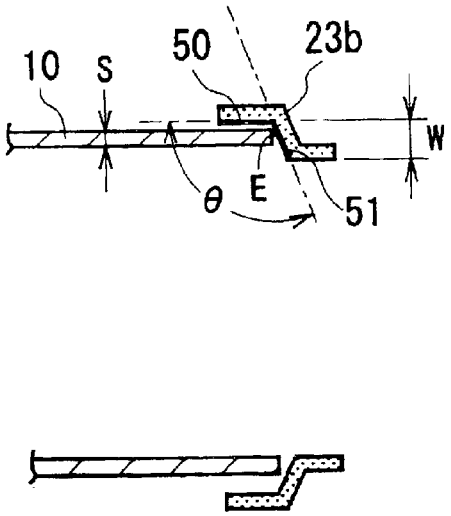
FIG. 15 is a schematic drawing for showing the relationship between the sleeve and the sleeve end flange, in the fixing apparatus in the second embodiment of the present invention.

The flange 23*b* in FIG. 15 is provided with a supporting portion 50 for catching and bracing the end portion E of the sleeve 10 by the peripheral surface, that is, a portion, the internal surface of which opposes the peripheral surface of the end portion of the sleeve 10, and a supporting portion 51 for catching the actual edge of the sleeve 10. The sleeve 10 has a certain amount of lengthwise play in the fixing apparatus, and never fails to shift toward the left or right flange 23*a* or 23*b*, coming into contact therewith. Therefore, the sleeve 10 is subjected to the reactive force from the edge catching portion 51 of the left or right flange 23*a* or 23*b*. The direction in which the sleeve 10 shifts is determined by the circularity of the sleeve 10 and pressure roller 30, pressure balance, alignment between the sleeve 10 and pressure roller 30, and the like factors. FIG. 15 shows the case in which the sleeve 10 has shifted right, and has come into contact with the right flange 23*b*.

Figure 14:
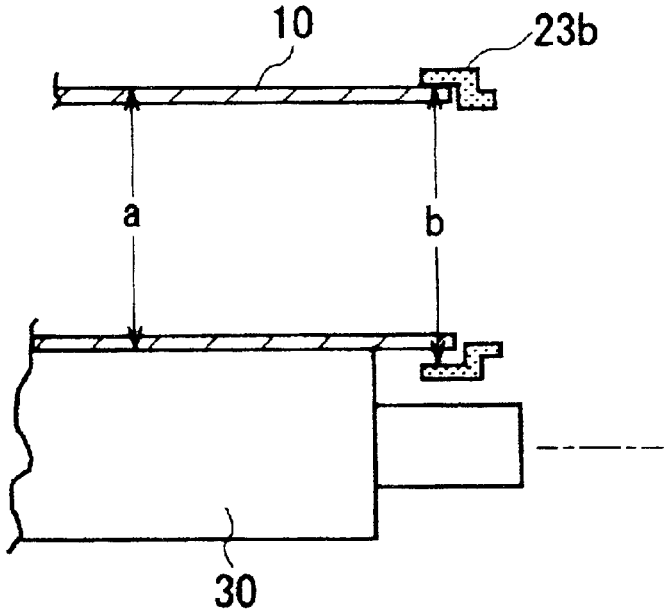
FIG. 14 is a schematic drawing for showing the relationship (5) between the sleeve and the sleeve end flange.

Referring to FIGS. 13 and 14, as a given portion of the end portion of the sleeve 10, in terms of the circumferential direction of the sleeve 10, is brought into the portion of its rotational range correspondent to the nip portion by the rotation of the sleeve 10, it is separated from the internal surface of the flange 23, whereas as it is brought into the portion of its rotational range opposite to the nip portion, it is pressed against the internal surface of the flange 23, generating a substantial amount of friction between itself and the internal surface of the flange 23, as will be evident from the description of the sleeve 10 in the first embodiment. This behavior of a given portion of the end portion of the sleeve 10 is repeated as the sleeve 10 is continuously rotated. Therefore, the dimension W (width in the diameter direction of flange) of the edge catching portion 51 must be greater than the thickness S of the sleeve 10. Otherwise, the edge catching portion 51 cannot properly catch the sleeve 10; the reactive force from the edge catching portion 51 does not properly act on the sleeve 10 to push back the sleeve 10 to center the sleeve 10.

Further, in this embodiment, the edge catching portion 51 of the flange 23*b* (23*a*) is inclined at an angle of θ) relative to the peripheral surface catching portion 50 of the flange 23*b* (23*a*), making it possible for the reactive force from the edge catching portion 51 to more effectively act on the sleeve 10 to push back the sleeve 10 to center the sleeve 10.

More specifically, the angle θ should be greater than 90 degrees (θ>90 deg). With this provision, the edge surface of the sleeve 10 does not squarely contact the edge catching portion 51 of the flange 23; in other words, only the corner E of the edge surface of the sleeve 10 contacts the inclined edge catching portion 51. Therefore, the sleeve 10 is smoothly pushed back in the centering direction.

When the angle θ was set to 90 deg. (θ=90 deg.), the friction generated between the edge of the sleeve 10 and the edge catching portion 51 of the flange 23 as the sleeve 10 is rotated was relatively large. Therefore, a given portion of the end portion of the sleeve 10, in terms of the circumferential direction of the sleeve 10, was sometimes prevented from smoothly deforming in the flange 23 as it was brought into the range correspondent to the nip portion. This problem was solved by setting the angle θ to be greater than 90 deg. (θ>90 deg.), making it possible for the sleeve 10 to always smoothly rotate.

Incidentally, when the angle θ was smaller than 90 deg. (θ<90 deg.), the edge of the sleeve 10 became wedged between the peripheral surface catching portion 50 of the flange 23, and the edge catching portion 51 of the flange 23 inclined at an acute angle relative to the peripheral surface catching portion 50. As a result, while the sleeve 10 was rotated, the end portion of the sleeve 10 was prevented from deforming in a manner shown in FIG. 13.

In this embodiment, the width of the peripheral surface catching portion 50, width of the edge catching portion 51, and angle θ, were made to be 5 mm, 1.5 mm, and 120 deg., correspondingly, for example. As a result, the sleeve 10 was very satisfactory in terms of durability.

To sum up, in this embodiment, the overall length of the sleeve 10 was made greater than the length of the portion of the pressure roller 30 which contacts the sleeve 10, and the fixing apparatus was structured so that the end portions of the sleeve 10 were fitted in the flanges 23*a* and 23*b*, one for one, each of which catches the corresponding end portion of the sleeve 10 by the peripheral surface and edge itself. Further, each flange 23(*a, b*) is provided with the portion 50 for catching the end portion of the sleeve 10 by the peripheral surface, and the portion 51, which is located on the outward side of the flange 23, for catching the edge of the sleeve 10, so that the edge of the sleeve 10 is caught by the edge catching portion of the flange 23 as the sleeve 10 shifts in its lengthwise direction. Moreover, the dimension W of the edge catching portion 51 of the flange 23, in terms of the diameter direction of the flange 23 was made greater than the thickness S of the sleeve 10. Therefore, the amount of the stress which occurred in the portion of the sleeve 10 immediately outside the nip portion, in terms of the lengthwise direction of the sleeve 10, was much smaller than that in the first embodiment. Consequently, the sleeve 10 lasted much longer compared to the one in the first embodiment. At the same time, the sleeve 10 was kept properly positioned by the flanges 23*a* and 23*b*. Therefore, the performance of the fixing apparatus remained stable throughout its service life.

<Embodiment 3>

The first and second embodiments concerned the structural arrangement for making the sleeve 10 last longer. That is, the movement of the sleeve 10 in its lengthwise direction was regulated by the provision of the flange 23 as described above. However, it was difficult to accurately position the sleeve 10 in terms of the direction perpendicular to the lengthwise direction of the sleeve 10. This was for the following reason. That is, the sleeve 10 was guided from its inward side by the sleeve guiding members 16*a* and 16*b* disposed within the loop of the sleeve 10. However, a given portion of the sleeve 10 variously deformed depending on where it was in the rotational path of the sleeve 10, for example, whether it was on the trailing side, in terms of the rotational direction of the sleeve 10, of the nip portion, in which it remained in contact with the pressure roller 30, whether it was in the nip portion, or whether it was on the leading side of the nip portion. Therefore, in order to allow the sleeve 10 to smoothly rotate, a slight gap was provided between the sleeve guiding member 16*a* and 16*b*, and the internal surface of the sleeve 10, and this gap was the reason for the aforementioned difficulty in accurately positioning the sleeve 10 in terms of the direction perpendicular to the lengthwise direction of the sleeve 10.

Figure 16:
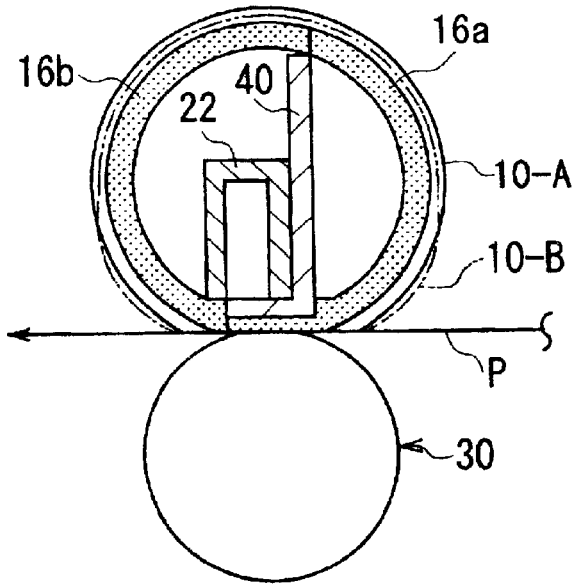
FIG. 16 is a schematic drawing for showing the relationship (1) between the sleeve and the sleeve end flange, in the fixing apparatus in the third embodiment of the present invention.

With the provision of this gap, the sleeve 10 in one fixing apparatus became different in cross sectional shape from the sleeve 10 in the other fixing apparatuses, as depicted by lines 10-A and 10-B in FIG. 16.

Therefore, the manner in which a given portion of the sleeve 10 came into contact with the paper P at the entrance and exit of the fixing nip during a given rotational cycle was different from that during the other rotational cycles. This sometimes affected the fixing performance, manner in which the paper P released from the sleeve 10, and manner in which the paper P was passed.

Figure 17:
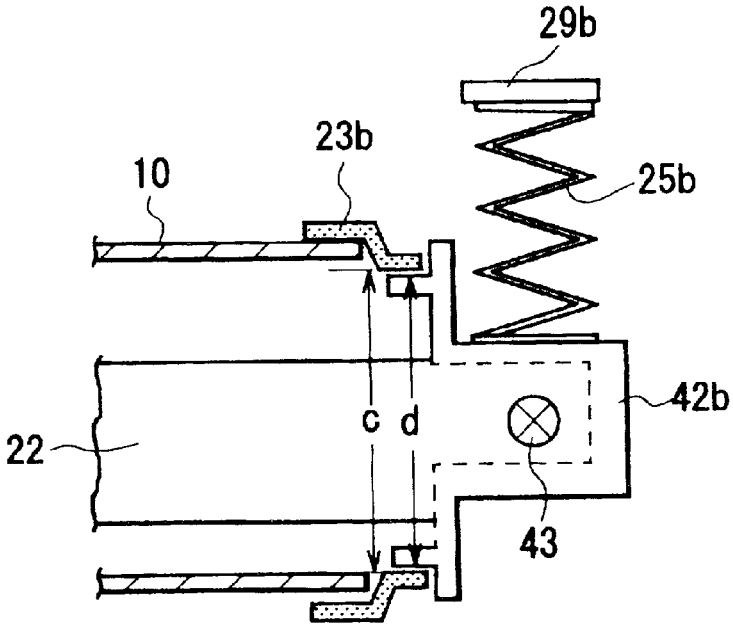
FIG. 17 is a schematic drawing for showing the relationship (2) between the sleeve and the sleeve end flange, in the fixing apparatus in the third embodiment of the present invention.

In comparison, in this embodiment, the fixing apparatus is provided with an end holder 42*b*, which is engaged with the flange 23*b* as shown in FIG. 17. Although FIG. 17 shows only the holder 42*b* for the right flange 23*b*, the fixing apparatus is also provided with a holder (referred to herein as holder 42*a*) for the left flange 23*a*. The end holder 42*b* is solidly fixed to the rigid pressure application stay 22 (which is directly fixed to the sleeve guiding members 16*a* and 16*b* as shown in FIG. 16, or indirectly fixed to the sleeve guiding members 16*a* and 16*b* with the interposition of the highly heat conductive member 40), with the use of small screws 43 or the like. In other words, the sleeve guiding members 16*a* and 16*b* and end holder 42*a* and 42*b* are solidly secured to each other, with the interposition of the rigid pressure application stay 22. Consequently, not only is the position of the sleeve 10 regulated by the sleeve guiding members 16*a* and 16*b*, but also it is regulated by the end holders 42*a* and 42*b*, with the interposition of the flanges 23*a* and 23*b*, at the lengthwise ends. In the case of the structure shown in FIG. 16, a portion of the external surface of the sleeve guiding member 16*a* (16*b*) doubles as the surface on which the sleeve 10 slides in the nip portion. In this case, the end holder 42*b* (42*a*) is stationary, whereas the sleeve 10 and flange 23*b* (23*a*) rotate together. Further, the peripheral surface of the portion of the end holder 42*b* (42*a*) fitted in the flange 23*b* (23*a*), and the internal surface of the portion of the flange 23*b* (23*a*), in which a portion of the end holder 42*b* (42*a*) is fitted, slide against each other, respectively. Therefore, a proper amount of gap is necessary between the aforementioned peripheral and internal surfaces of the end holder 42*b* (42*a*) and the flange 23*b* (23*a*); a proper amount of difference is necessary between the internal diameter c of the portion of the flange 23*b* (23*a*), in which a portion of the flange 23*b* (23*a*), in which a portion of the end holder 42*a* is fitted, and the external diameter d of the portion of the end holder 42*b* (42*a*) which fits into the flange 23*b* (23*a*).

Referring to FIG. 17, in this embodiment, the diameters c and d were made to be 32.4 mm and 32.0 mm, respectively, in order to provide a gap of 0.4 mm between the aforementioned peripheral and internal surfaces of the end holder 42*b* (42*a*) and flange 23*b* (23*a*), respectively. As a result, the sleeve 10 could be kept at a predetermined point, in terms of the direction perpendicular to its lengthwise direction, while allowing the flange 23*b* (23*a*) to rotationally slide on the peripheral surface of the end holder 42*b* (42*a*).

As for the material for the end holders 42*a* and 42*b*, the same heat resistant material as the one for the flanges 23*a* and 23*b* may be used; for example, PPS, LCP, PI, or the like. In addition, a certain metallic substance (brass or the like) may be used.

Further, in this embodiment, the rigid pressure application stay 22 was directly fixed to the flat portion of the internal surface of the sleeve guiding member 16*b*, or indirectly fixed thereto, with the interposition of the highly heat conductive member 40, as shown in FIG. 16 and described regarding the first embodiment, and the combination of these components are kept pressured toward the pressure roller 30 by the springs 25*b* (25*a*), with the interposition of the end holder 42*b* (42*a*) (FIGS. 2 and 3). Further, the sleeve guiding members 16*a* and 16*b* are joined with each other.

In other words, the end portion of the sleeve 10 and its adjacencies were structured as shown in FIG. 17. Therefore, the force generated by the resiliency of the springs 25*a* and 25*b* directly affects the manner in which the sleeve 10 and pressure roller 30 contact each other in the nip portion. In addition, the sleeve guiding members 16*a* and 16*b* and end holders 42*a* and 42*b* were properly sized, and are accurately secured to each other, respectively, in terms of their positional relationship. Therefore, the accurate positional relationships were maintained among the above described components.

Further, the thermistor 26 was attached to the sleeve guiding member 16*b* (or 16*a*) as shown in FIG. 2. Therefore, the positional relationship between the sleeve 10 and thermistor 26 remained stable, making it possible to accurately control the temperature of the sleeve 10.

Obviously, this embodiment may be devised for better performance. For example, a combination of the rigid pressure application stay 22, and sleeve guiding members 16*a* and 16*b*, or a combination of these components and the end holder 42*a* and 42*b*, may be integrally formed.

<Embodiment 4>

Figure 18:
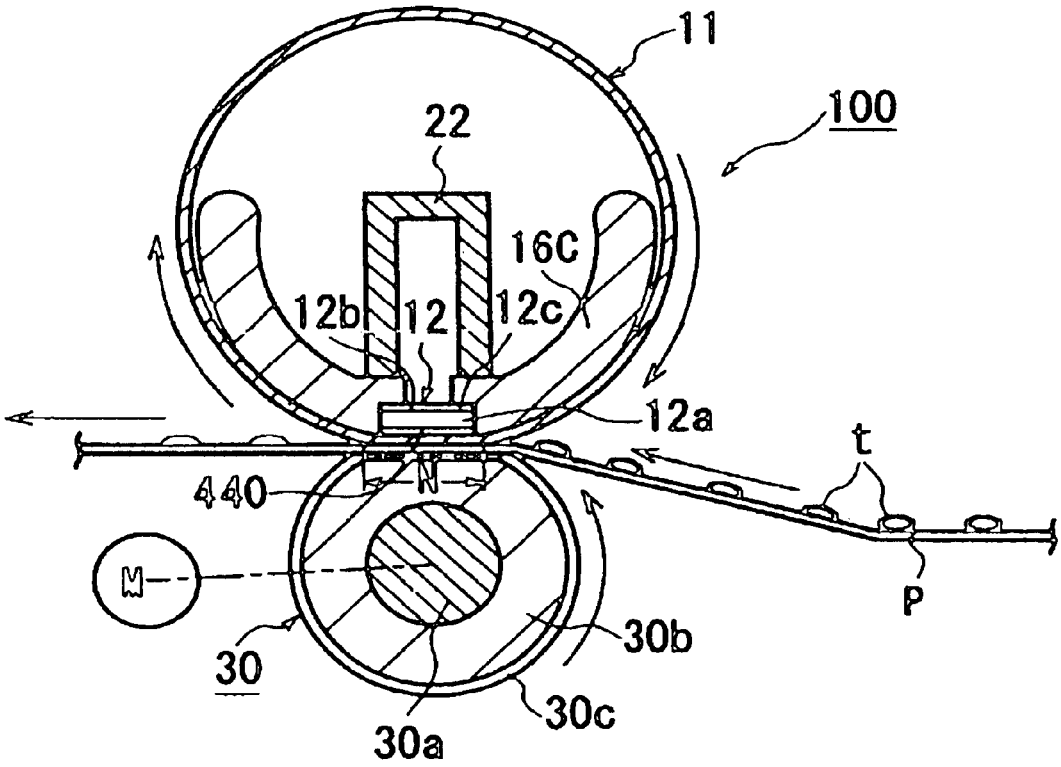
FIG. 18 is a schematic sectional view of the essential portion of the fixing apparatus in the fourth embodiment of the present invention, at a plane perpendicular to the axial line of the pressure roller of the fixing apparatus.

The fixing apparatus in this embodiment is a sleeve heating type fixing apparatus which employs a ceramic heater as a heating member. FIG. 18 is a schematic sectional view of the fixing apparatus 100 in this embodiment.

Designated by a referential code 16*c* is a heat resistant and heat insulating sleeve guide (film guide), which is in the form of a trough with an approximately semicircular cross section. Designated by a referential code 12 is a ceramic heater as a heating member, which is attached to the sleeve guide 16*c*, by being fitted in the groove of the sleeve guide 16*c*, which extends in the lengthwise direction of the sleeve guide 16*c*, in the bottom surface of the center portion of the sleeve guide 16*c*.

A referential code 11 designates a flexible cylindrical sleeve (endless film) which is formed of heat resistant film. This sleeve 11 is loosely fitted around the sleeve guide 16*c*.

A referential code 22 designates a rigid pressure application stay, which is put through the sleeve 11, being placed in contact with the inward surface of the sleeve guide 16*c*.

A referential code 30 designates a pressing member, which in this embodiment is an elastic pressure roller comprising a metallic core 30*a* and an elastic layer 30*b*. The elastic layer 30*b* is formed of silicone rubber or the like, and is coated on the peripheral surface of the metallic core 30*a* to reduce the hardness of the pressure roller 30. The pressure roller 30 is located between the unshown front and rear plates of the chassis of the fixing apparatus, being rotationally supported by the unshown front and rear plates, with the interposition of bearings, by the lengthwise ends of the metallic core 30*a*. In order to improve the surface properties, the peripheral surface of the elastic layer 30*b* may be covered with a layer 30*c* of fluorinated resin, for example, PTFE, PFA, or FEP.

The structure of the pressing means and the structure of the means (sleeve end flange) for holding the end portions of the sleeve 11 are similar to those in the first embodiment, and therefore, their descriptions will be not be given here.

The pressure roller 30 in this embodiment may be the same as that in the first embodiment. The pressure roller 30 is rotationally driven by a driving means M, in the counterclockwise direction indicated by an arrow mark in the drawing. As the pressure roller 30 is rotationally driven, friction occurs between the peripheral surface of the pressure roller 30 and the outwardly facing surface of the sleeve 10, in the fixing nip N. As a result, the sleeve 10 is rotated by the pressure roller 30, around the sleeve guiding member 16*c*, in the clockwise direction indicated by an arrow mark in the drawing, at a peripheral velocity substantially equal to the peripheral velocity of the pressure roller 30, with the inwardly facing surface of the sleeve 10 sliding on the bottom surface of the ceramic heater 12, in the fixing nip N (pressure roller driving method).

In order to reduce the friction between the bottom surface of the ceramic heater 12 and the internal surface of the sleeve 10 in the fixing nip N, the bottom surface of the ceramic heater 12 is covered with a lubricous member 440, or lubricant such as heat resistant grease is placed between the bottom surface of the ceramic heater 12 and the internal surface of the sleeve 10.

In response to a print start signal, the pressure roller 30 begins to be rotated, and the ceramic heater 12 begins to generate heat. Then, as the peripheral velocity of the sleeve 11 rotated by the rotation of the pressure roller 30, and the temperature of the ceramic heater 12, stabilize at their predetermined levels, the transfer medium P, as an object to be heated, which is bearing a toner image t, is introduced between the sleeve 11 and pressure roller 30, in the fixing nip portion N, with the toner image bearing surface of the transfer medium P facing the sleeve 11. Then, the transfer medium P is passed with the sleeve 11 through the fixing nip portion N, being pressed against the bottom surface of the ceramic heater 12, with the interposition of the sleeve 11.

While the transfer medium P is passed through the fixing nip portion N, the heat from the ceramic heater 12 is conducted to the transfer medium P through the sleeve 11. As a result, the toner image t is thermally fixed to the surface of the transfer medium P. After being passed through the fixing nip portion N, the transfer medium P is separated from the surface of the sleeve 11, and is conveyed further.

Figure 19:
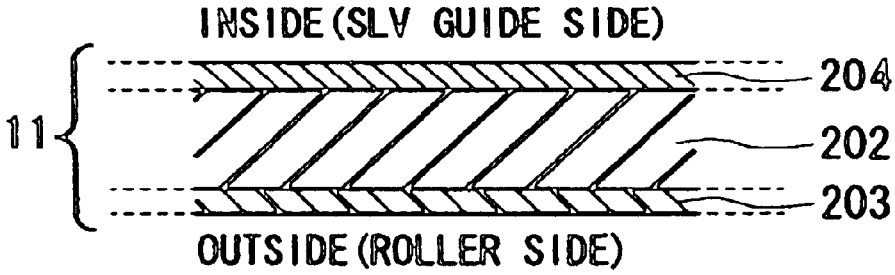
FIG. 19 is a schematic sectional view of the sleeve, and shows the structure thereof.

Referring to FIG. 19, the sleeve 11 is made up of a base layer 204, an elastic layer 202, and a release layer 203. For the durability of the sleeve 11, the base layer 204 is formed of 60 $\mu$m thick stainless steel film, instead of resin film, for example, PI film, which has been commonly used.

The elastic layer 202 is provided to improve the color image fixing performance of the sleeve 11. Thus, in the case of a black-and-white printer, the provision of the elastic layer 202 is not mandatory. In other words, the provision of the elastic layer 202 is optional. In this embodiment, silicone rubber which is 10 degree in hardness (JIS-A), and $4.18606\times 10^{-1}$ [W/m° C.] ($1\times10^{-3}$ [cal/cm.sec.deg.]) in thermal conductivity, is used to form the elastic layer 202 with a thickness of 200 $\mu$m. The release layer 203 is a 20 $\mu$m thick painted layer of PFA, although it may be a piece of PFA tube similar to the one used in the first embodiment. The method of forming the release layer 203 by painting PFA over the elastic layer 202 is superior to the method for forming the release layer 203 with use of PFA tube, in that the former can form a thinner release layer 203, and in that a release layer formed by painting is superior to a release layer formed with the use of PFA tube, in terms of the ability to press on the toner particles on the transfer medium P without disturbing the toner particles. On the other hand, a release layer formed of PFA tube is superior in mechanical and electrical strength than a release layer formed of painted PFA. Therefore, the selection between two methods may be made according to circumstances.

The ceramic heater 12 as a heating member is a linear heating member of a small thermal capacity, which extends in the direction perpendicular to the direction in which the sleeve 11 and transfer medium P move. Basically, it comprises: a substrate 12*a* formed of aluminum nitride or the like; a heat generating layer 12*b* extended on the surface of the substrate 12*a* in the lengthwise direction of the substrate 12*a*; and a protective layer 12*c* placed across the substrate 12*a* and heat generating layer 12*b*. The heat generating layer 12*b* is formed by painting the surface of the substrate 12*a* with electrically resistant substance such as Ag/Pd (sliver-palladium alloy), approximately 10 $\mu$m thick and 1–5 mm wide, by screen printing or the like. The protective layer 12*c* is formed of glass, fluorinated resin, or the like.

As electrical current is flowed from one end of the heat generating layer 12*b* of the ceramic heater 12 to the other end, the heat generating layer 12*b* generates heat, quickly raising the temperature of the heater 12. The temperature of the heater 12 is detected by an unshown temperature sensor, and the heater 12 is controlled by an unshown control circuit which controls the current to the heat generating layer 12*b*, in response to the temperature detected by the unshown temperature sensor, so that the temperature of the heater 12 is kept at a predetermined level.

The ceramic heater is fitted in the groove of the sleeve guide 16*c*, with its protective layer 12*c* being on the top side. The groove is in the downwardly facing surface of the sleeve guide 16*c*, extending from one lengthwise end of the sleeve guide 16*c* to the other, approximately in the middle. In the fixing nip portion N, the sleeve 11 slides on the surface of the lubricous member 40 of the ceramic heater 12, by its inwardly facing surface.

In a fixing apparatus structured as described above, an approximately 8 mm wide nip is formed between the ceramic heater 12, inclusive of the portions of the sleeve guide 16*c* adjacent to the ceramic heater 12, by applying a total pressure of 147.1 N (15 kg) to the pressure roller 30, with the interposition of the sleeve 11.

The relationship between the sleeve 11 and sleeve guide 16*c* in the fixing apparatus in this embodiment is the same as those in the first to third embodiments. When the lengthwise ends of the sleeve 11 were fitted with flanges 23*a* and 23*b* having the same structure as that in the first embodiment, and the gap Δt between the sleeve 11 and flange was set to 0.6 mm, for example, even the printing of approximately 300,000 copies did not damage the sleeve 11.

It is obvious that the structural arrangements in the second and third embodiments are also compatible with the fixing apparatus in this fourth embodiment, and that the application of such structural arrangements to the fixing apparatus in this embodiment will provide the same effects as those described regarding the preceding embodiments. The details will be not be given here.

Also in this embodiment, in order to reduce the deformation stress which occurs, as the sleeve 10 is rotated, in the portions of the sleeve 10 adjacent to the nip, in terms of the lengthwise direction of the sleeve 10, each of the lengthwise end portions of the sleeve 10 was loosely capped with the flange 23*a* (23*b*). The internal diameter of the flange 23*b* (23*a*) was made greater by a predetermined amount than the external diameter of the sleeve 10, as in the first embodiment, and/or the flange 23*b* (23*a*) was given the same configuration as that in the second embodiment. As a result, the durability of the sleeve 10 drastically increased. Further, the positions of the flanges 23*b* and 23*a* were regulated by the holders 42*b* and 42*a*, making it possible for the sleeve 10 to be properly braced by the flanges 23*b* and 23*a*. As a result, the manner in which the sleeve 10 was deformed in the adjacencies of the nip remained stable, providing stable fixing performance.

<Miscellanies>

In the fixing apparatuses in the first to fourth embodiments, the heat generating portion is located close to the fixing nip, making these fixing apparatuses superior in thermal response. Therefore, not only are they usable as a fixing apparatus for the printing apparatus in the first embodiment shown in FIG. 1, but also they are compatible with an incline type printer, which forms a full-color print, with the use of four photoconductive members. Further, the application of the present invention makes it possible to provide a highly durable fixing apparatus capable of withstanding the rigor of repeated high speed printing operations.

It is obvious that not only is a heating apparatus in accordance with the present invention usable as an image fixing thermal apparatus, but also as an image heating apparatus for heating a recording medium, on which an image is present, in order to improve the surface properties, such as gloss, of the image, an image heating apparatus for temporarily fixing an image, a heating apparatus for drying or laminating an object in the form of a sheet (object is conveyed through the heating apparatus), and the like. In other words, a heating apparatus in accordance with the present invention can be used as an apparatus for heating a wide range of objects.

While the invention has been described with reference to the structures disclosed herein, it is not confined to the details set forth, and this application is intended to cover such modifications or changes as may come within the purposes of the improvements or the scope of the following claims.

What is claimed is:

1. An image heating apparatus comprising:

a flexible rotatable member contactable to a recording material carrying an image;

a back-up member disposed in said rotatable member;

a pressure roller for forming with said back-up member a nip portion with said rotatable member therebetween, the nip being effective to feed the recording material, wherein said rotatable member is deformed to form the nip; and a limiting member for limiting movement of said rotatable member in a direction of a generating line of said rotatable member, wherein said limiting member is provided with a surface opposed to an outer peripheral surface of an end portion of said rotatable member, and wherein the outer peripheral surface of said rotatable member includes a surface portion which is in contact with the opposed surface of said limiting member and a surface portion which is out of contact with the opposed surface of said limiting member by the deformation of said rotatable member, wherein a diameter a of the outer peripheral surface of said rotatable member in a state that said rotatable member is free of deformation, a diameter b of the opposed surface of said limiting member, and Δt=b−a, satisfy a formula wherein 0.009 is equal to or smaller than Δt/a which is equal to or smaller than 0.03.

2. An apparatus according to claim 1, wherein said limiting member rotates with said rotatable member by friction at the surface portion which is in contact to the opposed surface of said limiting member.

3. An apparatus according to claim 1, wherein Δt is 0.3 mm–1.0 mm.

4. An apparatus according to claim 1, wherein said limiting member further includes a second surface for receiving an end surface of said rotatable member, and an angle formed between the surface opposed to the outer peripheral surface and the second surface is larger than 90 degrees.

5. An apparatus according to claim 1, further comprising a holder for rotatably holding said limiting member.

6. An apparatus according to claim 5, wherein said holder is effective to limit movement of said limiting member in the direction of the generating line.

7. An apparatus according to claim 5, further comprising a guiding member for guiding said rotatable member inside said rotatable member, wherein said holder is directly or indirectly fixed to said guiding member.

8. An apparatus according to claim 1, wherein said limiting member is made of heat-resistive resin material.

9. An apparatus according to claim 1, wherein said rotatable member has a metal layer.

10. An apparatus according to claim 9, further comprising a coil for generating a magnetic field for inducing eddy currents in said metal layer, wherein the image on the recording material is heated by heat from said metal layer in which heat is produced by the eddy currents.

11. An apparatus according to claim 1, wherein said back-up member includes a heater contacted to an inner peripheral surface of said rotatable member, and wherein the image on the recording material is heated by heat from said heater through said rotatable member.

12. An image heating apparatus comprising:

a flexible rotatable member contactable to a recording material carrying an image;

a back-up member disposed in said rotatable member;

a pressure roller for forming with said back-up member a nip portion with said rotatable member therebetween, the nip portion being effective to feed the recording material, wherein said rotatable member is deformed to form the nip portion; and a ring-like member in contact with an outer peripheral surface of an end portion of said rotatable member, wherein the outer peripheral surface of an end portion of said rotatable member includes an area which is in contact with said ring-like member and an area which is out of contact with said ring-like member, and wherein a diameter a of the outer peripheral surface of said rotatable member in a state that said rotatable member is free of deformation, a diameter b of a surface opposed to the outer peripheral surface of said rotatable member of said ring-like member, and $\Delta t=b-a$, satisfy a formula wherein 0.009 is equal to or smaller than $\Delta t/a$ which is equal to or smaller than 0.03.

13. An apparatus according to claim 12, wherein said ring-like member is rotationally driven by said rotatable member through friction at a contact area therebetween.

14. An apparatus according to claim 12, wherein said ring-like member has an inner diameter which is larger than a diameter of the outer peripheral surface of said rotatable member.

15. An apparatus according to claim 12, wherein said rotatable member has a metal layer.

16. An apparatus according to claim 15, further comprising of coil for generating a magnetic field for inducing eddy currents in said metal layers, wherein the image on the recording material is heated by heat from said metal layer in which heat is produced by the eddy currents.

17. An apparatus according to claim 12, wherein said back-up member includes a heater contacted to an inner peripheral surface of said rotatable member, and wherein the image on the recording material is heated by heat from said heater through said rotatable member.

* * * * *

UNITED STATES PATENT AND TRADEMARK OFFICE

CERTIFICATE OF CORRECTION

PATENT NO. : 6,937,837 B2
DATED : August 30, 2005
INVENTOR(S) : Akihiko Takeuchi et al.

It is certified that error appears in the above-identified patent and that said Letters Patent is hereby corrected as shown below:

Column 2,
Line 8, “employs” should read -- employ --.

Column 3,
Line 38, “th” should read -- the --.

Column 7,
Line 56, “prints” should read -- print --.

Column 15,
Line 57, “polyimde” should read -- polyimide --.

Column 17,
Line 11, “Δt(=bxa)” should read -- Δt(=b-a) --.

Column 18,
Line 9, “flange” should read -- flanges --.

Column 22,
Line 40, “of” should read -- for --.

Column 23,
Line 55, “<miscellanies>” should read -- <miscellaneous> --.

Column 24,
Line 24, “portion” should be deleted.

UNITED STATES PATENT AND TRADEMARK OFFICE

CERTIFICATE OF CORRECTION

PATENT NO. : 6,937,837 B2
DATED : August 30, 2005
INVENTOR(S) : Akihiko Takeuchi et al.

It is certified that error appears in the above-identified patent and that said Letters Patent is hereby corrected as shown below:

Column 26,
Line 19, “of coil” should read -- a coil --.
Line 20, “layers,” should read -- layer, --.

Signed and Sealed this

Fourteenth Day of February, 2006

JON W. DUDAS
*Director of the United States Patent and Trademark Office*